US008757913B2

(12) United States Patent
Geuther et al.

(10) Patent No.: US 8,757,913 B2
(45) Date of Patent: Jun. 24, 2014

(54) APPLICATOR AND COSMETIC DEVICE HAVING THE APPLICATOR

(75) Inventors: Manuela Geuther, Ansbach (DE); Erwin Schuster, Bechhofen (DE)

(73) Assignee: GEKA GmbH, Bechhofen (DE)

( * ) Notice: Subject to any disclaimer, the term of this patent is extended or adjusted under 35 U.S.C. 154(b) by 350 days.

(21) Appl. No.: 13/193,333

(22) Filed: Jul. 28, 2011

(65) Prior Publication Data

US 2012/0045268 A1 Feb. 23, 2012

(30) Foreign Application Priority Data

Jul. 30, 2010 (DE) ..... 20 2010 010 860 U

(51) Int. Cl.

| | |
|---|---|
| ***A46B 11/00*** | (2006.01) |
| *A45D 40/26* | (2006.01) |
| *A45D 40/28* | (2006.01) |

(52) U.S. Cl.

CPC ..... *A45D 10/265* (2013.01); *A45D 40/262* (2013.01); *A45D 40/28* (2013.01)

USPC ..... 401/129; 132/218; 401/126

(58) Field of Classification Search

CPC . A45D 34/045; A45D 40/265; A45D 40/262; A45D 40/28

USPC ..... 401/126–130; 132/218

See application file for complete search history.

(56) References Cited

U.S. PATENT DOCUMENTS

| | | | | |
|---|---|---|---|---|
| 4,458,701 | A | 7/1984 | Holland | |
| 5,007,442 | A * | 4/1991 | Hirzel | 132/218 |
| 5,086,793 | A | 2/1992 | Kingsford | |
| 2008/0006287 | A1 * | 1/2008 | Gueret | 132/218 |
| 2012/0282008 | A1 * | 11/2012 | Geuther et al. | 401/122 |
| 2013/0114989 | A1 * | 5/2013 | McNamara et al. | 401/130 |

FOREIGN PATENT DOCUMENTS

WO WO 2004077987 A1 * 9/2004

* cited by examiner

*Primary Examiner* — David Walczak
*Assistant Examiner* — Jennifer C Chiang
(74) *Attorney, Agent, or Firm* — Setter Roche LLP

(57) ABSTRACT

An applicator for cosmetics, in particular a mascara applicator, having an applicator device embodied in the form of a fan, and applicator elements constituting the fan are movable from a first fan position into a second fan position and/or vice versa, with the applicator elements being folded-in closer to one another in the first fan position or fanned-out farther from one another in the second fan position.

32 Claims, 20 Drawing Sheets

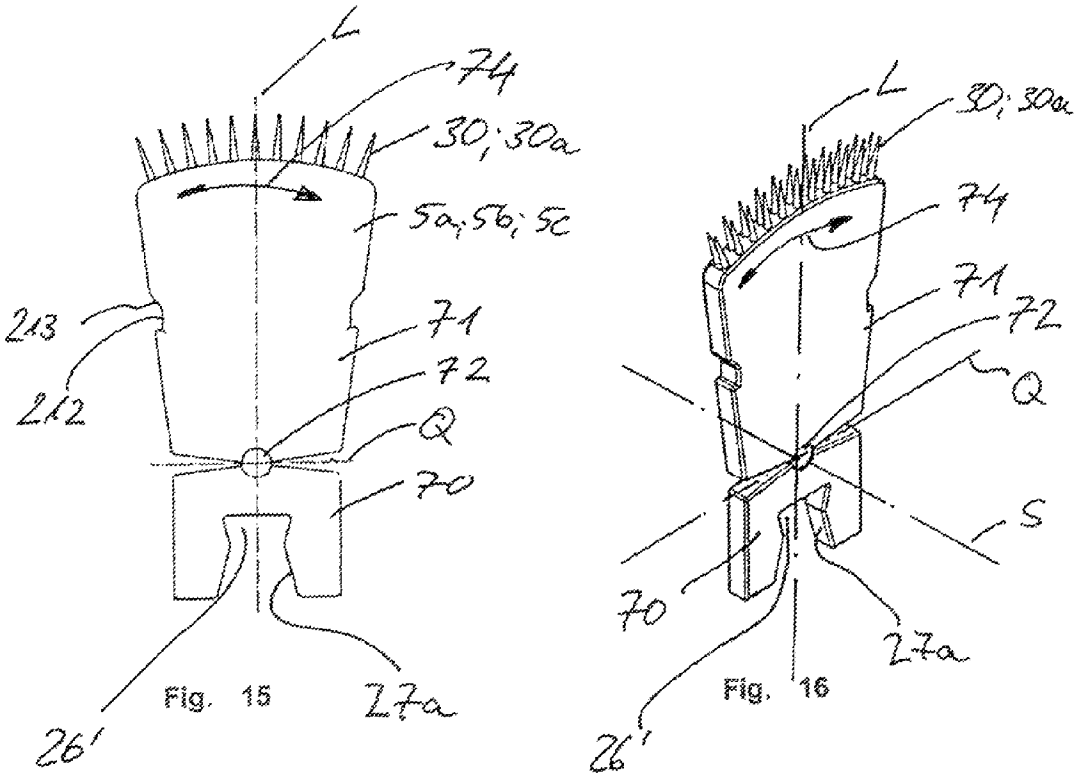
Fig. 15
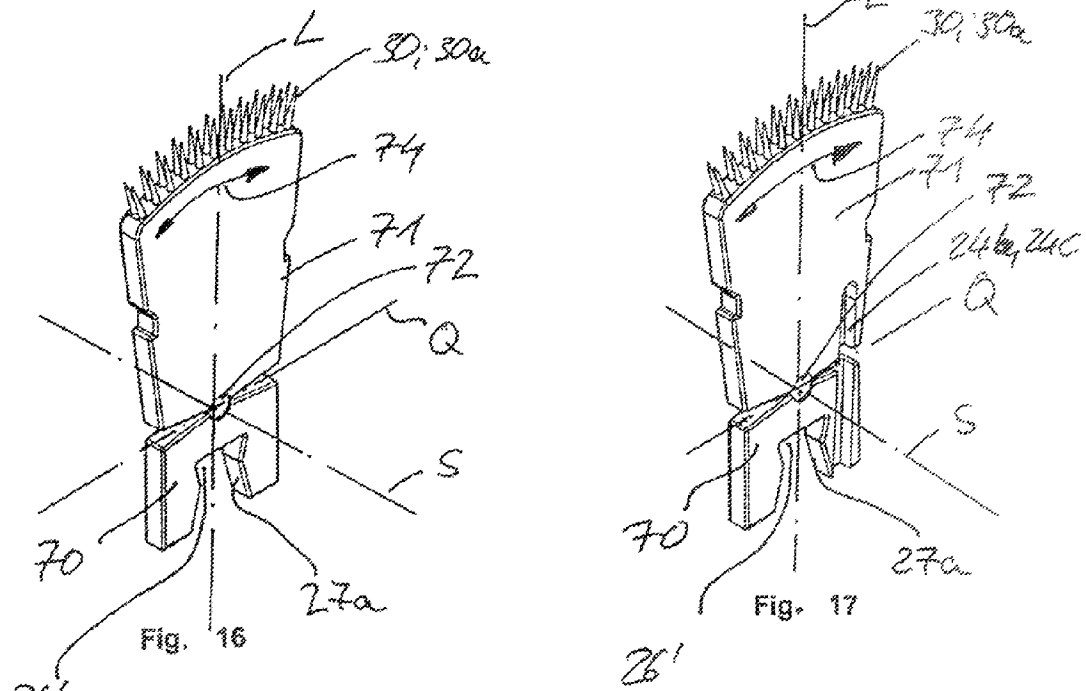
Fig. 16
Fig. 17

APPLICATOR AND COSMETIC DEVICE HAVING THE APPLICATOR

FIELD OF THE INVENTION

The invention relates to an applicator, as well as a cosmetic device having the applicator.

BACKGROUND OF THE INVENTION

An applicator of this generic type is known from U.S. Pat. No. 5,086,793. Such an applicator has a grip piece on which a longitudinally extending shaft element is situated. The shaft element has a comb-like applicator region with teeth extending perpendicular to the longitudinal axis of the applicator in its distal, i.e. free, end region. The shaft element and the applicator region are divided along a longitudinal center plane, which extends parallel to the longitudinal axis of the applicator, dividing it centrally into two applicator halves or shaft halves. One of the shaft/applicator halves is supported in stationary fashion relative to the grip piece. The other of the shaft/applicator halves is supported so that it can move a certain distance relative to the grip piece along the longitudinal direction of the applicator so that in a first end position, teeth of applicator regions are aligned with one another in pairs, thus producing a maximum tooth spacing between adjacent pairs of teeth. In a second end position, the teeth of the one applicator half are situated in the gaps between the teeth of the other applicator half and thus reduce an effective tooth spacing. This means that the internal width is halved between the teeth of the one applicator half and the teeth of the other applicator half. The teeth of this applicator are essentially the shape of flat plates, so that duct-like compartments for accommodating mascara are formed between the teeth. In a second embodiment, the teeth are semi-circular in cross-section like a longitudinally split half cylinder, with two corresponding half-cylinders forming a cylindrical tooth in one end position. In a second position in which they are shifted relative to each other, the longitudinally split half cylinders each form a separate respective tooth.

For the generic applicator described above, it is disadvantageous that at least one of the applicator halves is stationary, namely the one that is connected to the grip piece.

The variability in terms of different teeth, shapes, tooth geometries, and the like is therefore limited. In addition, a relatively large amount of structural complexity is required to achieve a precise guidance of the applicator halves relative to each other.

Another disadvantage is that the applicator halves contact each other over a very large area compared to the total length of the applicator, so that the applicator halves can be expected to have a distinct tendency to become unintentionally stuck to each other. This can significantly limit the functionality of the applicator in use due to the presence of dried Mascara compound. Another disadvantage is that a mere halving of the effective tooth spacing of the kind that is possible with the generic applicator described above is often insufficient, especially with regard to the particular requirements for separating eyelash hairs.

The object of the invention therefore is to disclose an adjustable applicator that is easy to manufacture and in particular can be manufactured economically. It is particularly desirable to limit the number of different parts required to produce the applicator according to the invention.

Particular attention should be paid to disclosing an actuating mechanism for the adjustable applicator that is particularly easy to assemble and is rugged and reliable in operation.

In particular, one object of the invention is to make it possible to produce a variety of different applicators with one and the same actuating device.

Another object of the invention is to improve user ergonomics and ergonomic conditions when applying mascara to eyelashes as compared to the prior art.

Another object of the invention is to disclose a cosmetic device that is easy to use and is equipped with the applicator according to the invention.

SUMMARY OF THE INVENTION

To attain these objects, the invention provides an applicator for cosmetics, in particular a mascara applicator, having at least one grip piece on which at least one applicator device is arranged; the applicator device has at least two applicator elements that are movable relative to each other. According to the invention, such an applicator is characterized in that the applicator device is embodied to resemble a fan and the applicator elements composing the fan can be moved from a first fan position into a second position that is fanned out wider or folded in narrower than the fan first position and/or vice versa.

In particular, the applicator elements each support a set of bristles; the bristles of the applicator elements are shifted relative to one another by the different degrees to which the fan-like applicator device is fanned out and it is thus possible to achieve different internal widths between bristles of adjacent applicator elements into which eyelashes can travel during application. As a result, supporting the applicator elements so that they are able to fan out or in relative to one another produces a fan-like applicator device in a simple way, permitting the user to set a wide variety of effective bristle spacings that are relevant for applying mascara, e.g. to eyelashes.

With such an applicator, by means of only a minimal mechanical pivoting, i.e. in particular by fanning out the applicator elements relative to one another or by folding them in relative to one another, it is easily possible to carry out an infinitely variable or detent-indexed adjustment of the effective spacing of the bristles situated on the applicator elements. By means of this, it is in particular possible to disclose an applicator that is adjustable within a wide range with regard to the effective bristle spacing, permitting both a volumizing effect, which is often sought in the field of eyelash cosmetics, and also an often-sought separating effect to be achieved with one and the same applicator.

To actuate the pivotably supported, in particular at least partly overlapping applicator elements, it is suitable for the shifting in both directions to occur in a positively guided fashion through form-locked engagement by means of an actuating mechanism or for the shifting in at least one direction to occur in a spring-loaded fashion, for example by means of a spring element. In the first case, the guidance and the position of the applicator elements relative to one another in a mechanical, precisely defined fashion is implemented with particular accuracy, whereas in the second case, a significant simplification of the design can be achieved, particularly with regard to the actuating device.

It has in particular proven to be useful to provide the distal front surfaces of the applicator elements with distally extending bristles, in particular radially arranged distally extending bristles.

In a particular embodiment of the invention, the applicator is equipped with applicator elements that have a plate-like or shell-like three-dimensional form and in an extreme position, i.e. in a position in which they are maximally or minimally pivoted relative to one another, have a maximum effective bristle spacing $d_{WMax}$, relative to one another in a projection perpendicular to the plate plane of the applicator elements or perpendicular to the tangential plane of the shell-like applicator elements. This is achieved, in particular, if the bristles of the applicator elements are aligned with bristles of the adjacent applicator elements. Positioning them this way achieves the applicator position that makes it particularly easy to achieve a volumizing effect because the bristles have an effective bristle spacing that permits several eyelashes to travel into one gap between two adjacent bristles, allowing the eyelashes to be bundled in this gap and allowing mascara compound to be applied to them as a unit.

To embody the fan, it has turned out to be suitable to embody the applicator elements to resemble the slats of a folding fan and to arrange them so that they can pivot relative to the grip piece around a pivot axis S. It is useful in this context for the pivot axis S to enclose an angle δ with the longitudinal axis L of the applicator; the angle δ can lie within a wide range between 45° and 90°. Preferably, the value of the angle δ lies in a range between 75° and 90°. Particularly preferably, the pivot axis S is perpendicular to the longitudinal axis L, so that the angle δ is equal to 90°.

If the pivot axis S is situated at an angle δ other than 90° relative to the longitudinal axis L, then this makes it possible to embody "angled" applicators in a simple way, i.e. the applicator elements or their planes are oriented at an angle relative to the longitudinal axis L of the applicator. This makes it possible to carry out a further ergonomic optimization of the applicator if necessary.

With regard to a pivoting motion around the pivot axis S, it has turned out to be particularly suitable for one of the at least two applicator elements or at least one additional applicator element to be rigidly connected to the grip piece, in particular in a releasably rigid fashion, or even for it to be integrally connected to the grip piece. This results in a particularly simple design and especially with the use of a total of three applicator elements, permits a particularly simple mechanical triggering of the applicator elements to produce various desired effective bristle spacings $d_W$.

As an alternative to a positively guided actuation of the applicator elements in their pivoting movement, at least one of the extreme positions of the movable applicator elements can be achieved by means of an elastic element, so that the movable applicator elements are prestressed in the direction of a maximum deflection and an actuating device can move them in opposition to the spring force out of this position of maximum deflection and position them relative to one another in an infinitely variable or detent-indexed fashion.

Such an embodiment can help provide the actuating device with the simplest possible embodiment because the actuating device only has to produce a movement in a single pivoting direction of the applicator elements.

The free front surfaces of the applicator elements suitably support respective bristles that are in particular embodied in the form of bristles that are integrally injection-molded onto the applicator elements; the bristles are spaced apart by a distance d and in at least one position of the fan composed of applicator elements, the bristles of adjacent applicator elements, in particular all of them, are aligned with one another so that in this position, a maximum effective bristle spacing $d_{WMax}$ is produced.

On the other hand, it is particularly useful to embody the actuating device so that when two or n applicator elements are provided, in a second or nth position of the applicator elements, the bristles have an effective bristle spacing $d_W$, which is equal to half or the nth part of the maximum effective bristle spacing $d_{WMax}$. This makes it easily possible, for example when using two applicator elements, to provide one extreme position with a maximum effective bristle spacing $d_{WMax}$ and another extreme position with a bristle spacing $d_W = \frac{1}{2} d_{WMax}$. It is naturally also possible to produce effective bristle spacings $d_W$ that are smaller than half the maximum effective bristle spacing $d_{WMax}$, but when two applicator elements are provided, this means that there are always bristle gaps that have a spacing larger than $\frac{1}{2} d_{WMax}$. For example when three applicator elements are used, in one extreme position, the maximum bristle spacing $d_{WMax}$ can be set and in the other extreme position, a minimum bristle spacing can be set, which is evenly distributed over a certain region of the bristle field and amounts to ⅓ of the maximum effective bristle spacing $d_{WMax}$. In such an extreme position, the applicator is particularly suitable for achieving a separating effect.

The actuating device for actuating the applicator elements is suitably embodied in the form of a sliding mechanism; a slider is provided, which is able to slide axially along a longitudinal axis of the applicator and is equipped with actuating edges or actuating tabs, which cooperate in a positively guided fashion with an outer edge or with an actuating groove of the applicator elements in order to pivot the movable applicator elements. This is a particularly simple option for causing the applicator elements to fan out and fold back in.

The slider, which is suitably embodied so that it can make a fluid-tight, in particular air-tight, fit with a stripper of a cosmetic device to prevent mascara compound from leaking out of a container of the cosmetic device or drying out.

As an alternative, the actuating edges or actuating tabs can be actuated by means of a rotating mechanism or sliding mechanism.

According to one particular embodiment, the applicator elements can be composed of an elastically deformable material and in particular, have a spherically curved three-dimensional form; the applicator elements here are arranged like shells stacked inside one another and are arranged so that they can be fanned out and folded back in. This measure makes it possible to produce various worthwhile alternative designs of the applicator device and among other things, can have a positive influence on the ergonomics of an applicator according to the invention.

In order to provide a multitude of bristles involved in the application of mascara, it is advisable to arrange the bristles of an applicator element in several rows extending side by side, so that each applicator element is equipped with double rows or multiple rows of bristles. Naturally, it is also possible to use applicator elements equipped with bristles in a single row.

The length, the three-dimensional form, or the hardness and flexibility of the bristles on the applicator elements can be suitably embodied as different from one another in order to adjust the application properties.

To accomplish this, for example the length of the bristles of a first applicator element can be different from the length of the bristles of a second applicator element.

A structurally simple possibility turns out to be to produce both the pivoting and the rigid support of the individual applicator elements by means of a bearing structure that is preferably integrally connected to the grip piece. In this case, the applicator elements can be clipped onto the bearing structure and the bearing structure has a bearing axle particularly for the movable applicator elements. For applicator elements that are to be rigidly attached, closing devices such as bridge pieces are provided, which cooperate with corresponding stop edges of the applicator elements and thus prevent these applicator elements from being able to pivot.

It is particularly advantageous to embody the plurality of applicator elements with geometric three-dimensional forms that are identical to one another. On the one hand, this reduces the required complexity of molds and forms. On the other, it eliminates confusion when assembling a plurality of applicator elements. This measure achieves a particularly economical applicator.

Naturally, however, the applicator elements can also have different three-dimensional forms from one another. This does increase mold costs and thus production costs, but the different applicator elements can be used to produce applicators that are specifically designed to achieve specific application properties, with a particular fan composition of the applicator elements.

In addition, the invention provides a cosmetic device equipped with at least one applicator according to the invention and in a preferred embodiment, the cosmetic device is also equipped with a container for mascara compound, a stripper, and a closing device for holding and sealing the applicator relative to the container. For example, the closing device can be a cap, which completely encloses or surrounds the applicator protruding from the container. As an alternative, the closing device can also be a closing bracket, which for example cooperates with a collar of the applicator and holds it so that in the closed state, at least the grip piece of the applicator remains partially uncovered. This variant has the advantage that the applicator can be held in the container in both a maximally retracted position, which corresponds, for example, to a maximally fanned-out position of the applicator elements, and in a maximally extended position, which corresponds, for example, to a maximally folded-in position of the applicator elements.

As an alternative, a cap can be provided that when placed onto the container, acts on an applicator, which may be an extended position, by compressing it again to such a degree that when it is used again, i.e. when the applicator is taken back out of the container, the applicator is always in a predetermined, definite position. This position can either be one of the extreme positions, i.e. with the applicator elements in the maximally fanned-out position or with the applicator elements in the minimally fanned-out position, or it can be a middle position that can be produced as needed by the matching geometrical design of the cap.

However, it is naturally also possible to provide a gap between the cap and the applicator, which gap is large enough to permit the applicator to be arranged in any extended or non-extended position under the cap despite the fact that the cap completely envelops the applicator. When the applicator is taken out again, such a variant has the advantage of permitting the user to always pull it out in the same position in which it was last used, i.e. in a position that the user prefers. This makes it possible to minimize unwanted adjusting procedures.

An example of the invention will be described in greater detail below in conjunction with the drawings.

BRIEF DESCRIPTION OF THE DRAWINGS

FIG. 15 is a top view of an applicator element from another embodiment of a possible support for applicator elements of an applicator according to the invention, which allows them to pivot in an articulated fashion;

FIG. 16 is an isometric view of the applicator element according to FIG. 15;

FIG. 17 shows the applicator element according to FIGS. 15 and 16, also equipped with an actuating groove;

DETAILED DESCRIPTION OF THE PREFERRED EMBODIMENTS

Figure 1:
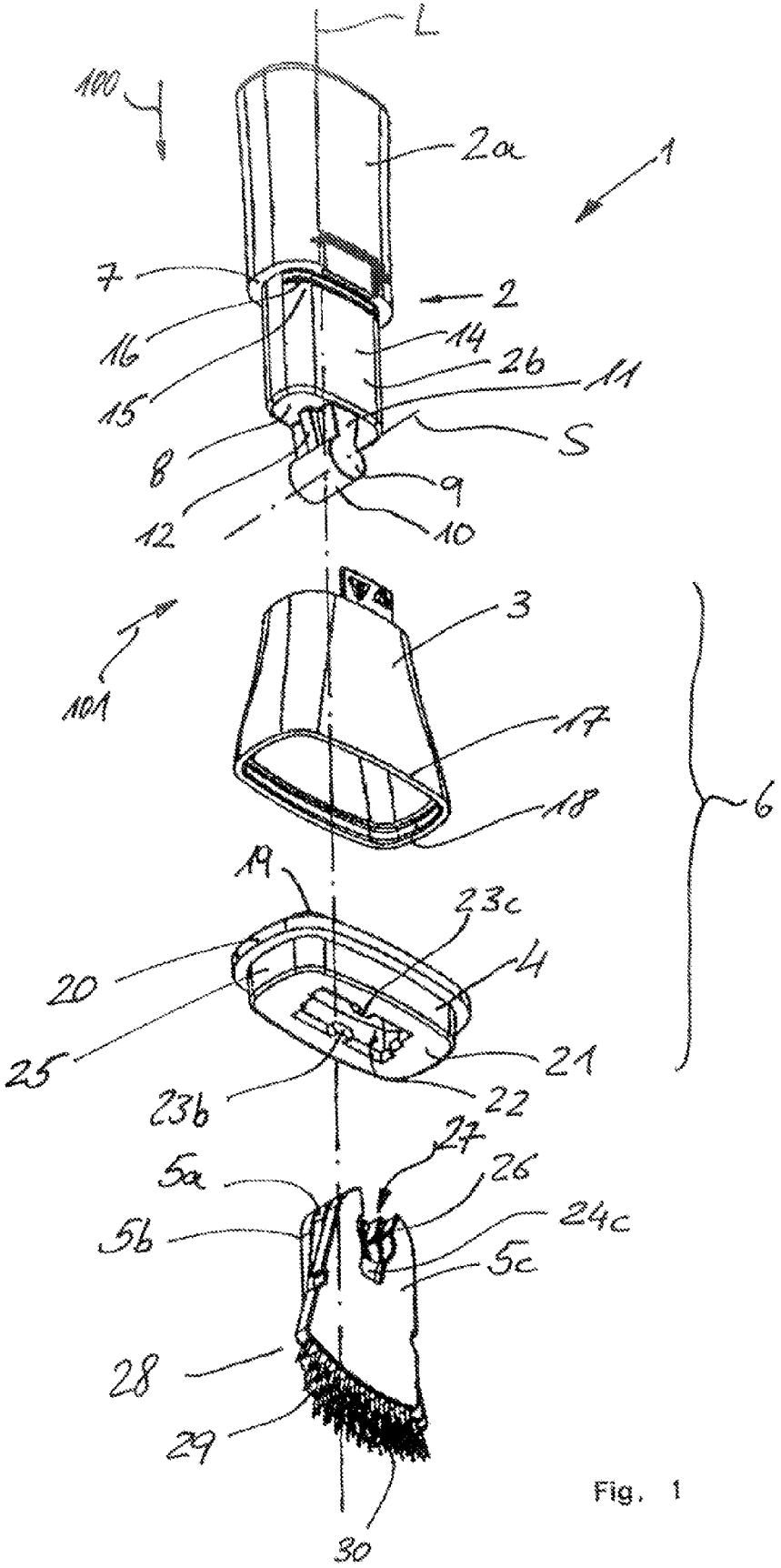
FIG. 1 is an exploded view of a first embodiment of an applicator according to the invention.
Figure 2:
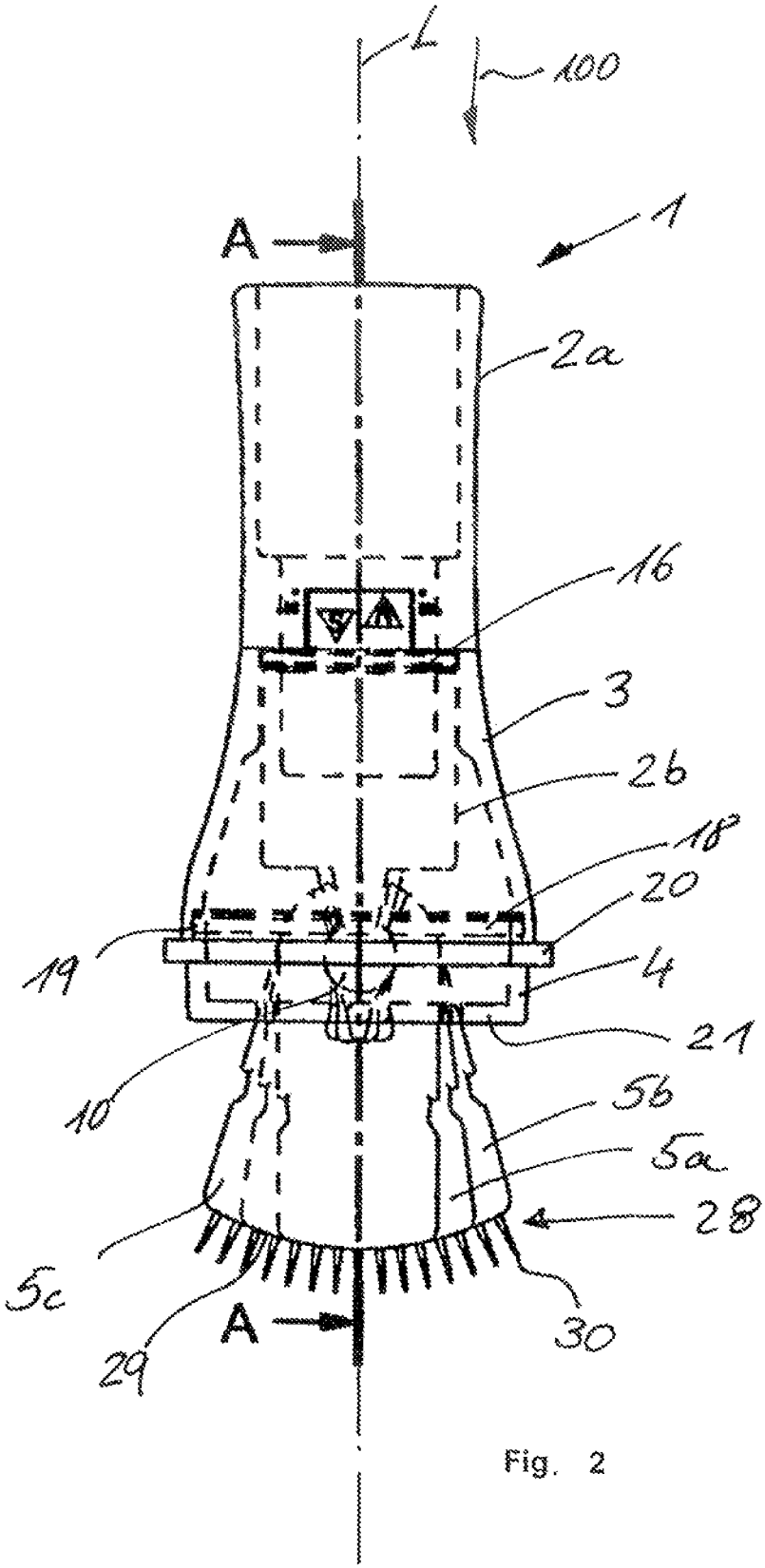
FIG. 2 is a side view of the applicator according to FIG. 1 in the assembled state, with the hidden lines shown.
Figure 3:
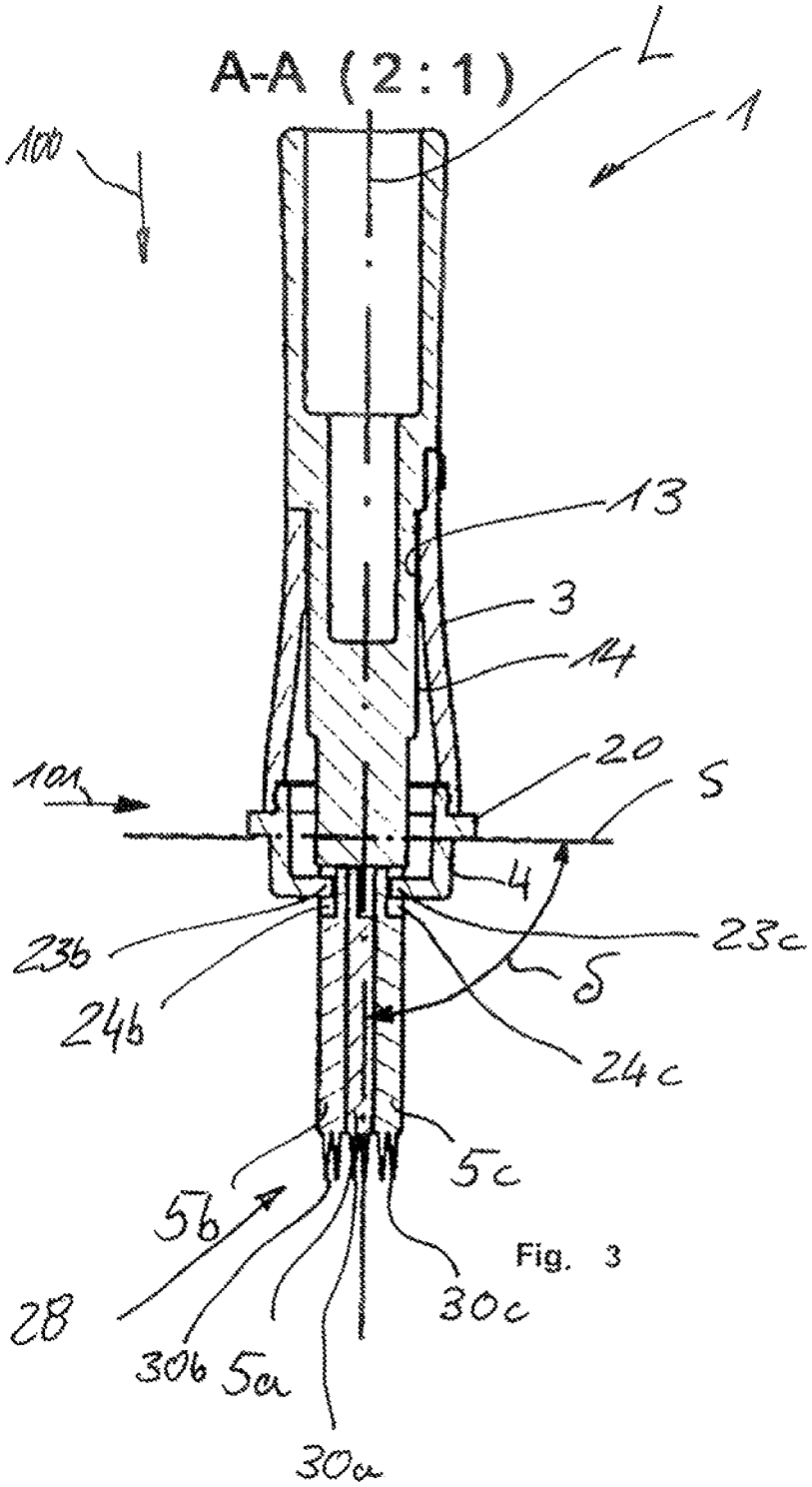
FIG. 3 is a longitudinal section through the applicator according to FIG. 1 along the section line A-A from FIG. 2.

A first embodiment of an adjustable applicator 1 according to the invention is shown in FIGS. 1 through 3; FIG. 1 is an exploded view, which shows individual parts of the applicator 1 lined up along a longitudinal axis L. The applicator 1 has a grip piece 2, a control element 3, a slider 4, and a fan-like applicator device 5 composed of a middle applicator element 5*a*, a first outer applicator element 5*b*, and a second outer applicator element 5*c*. The control element 3 and the slider 4 form an actuating device 6 for moving the adjustable applicator 1 according to the invention.

A longitudinal direction 100 parallel to the longitudinal axis L is defined in order to facilitate further description. The grip piece 2 has a holding region 2*a* to allow the user to hold the applicator. Starting from the holding region 2*a*, a distal direction is defined that coincides with the longitudinal direction 100. A proximal direction is defined as the direction opposite the longitudinal direction 100. In the description that follows, the holding region 2*a* serves as the point of reference for the terms distal and proximal.

In addition to the holding region 2*a*, the grip piece 2 has a sliding tube 2*b*, which is connected to the distal end of the holding region 2*a* and forms a step 7. At its distal end 8, the sliding tube 2*b* has a bearing structure 9, which extends a short way out from the distal end 8 in the longitudinal direction 100. The bearing structure 9 has a bearing axle 10, which is supported on a bearing stand 11, which widens out in wedge fashion as it extends from the bearing axle 10 toward the distal end 8. The bearing axle 10 forms a pivot axis S on which the applicator elements 5*a*, 5*b*, 5*c* are secured in pivoting or rigid fashion, as described in greater detail below. The pivot axis S encloses an angle δ with the longitudinal axis L; in the exemplary embodiment, this angle δ is 90°. If an angled position of the applicator device 5 relative to the grip piece 2 is to be achieved, then the angle δ can also be suitably selected to lie in the range 45°≤δ<90°, particularly in the range 75°≤δ<90°. Along a direction 101, which is oriented parallel to the pivot axis S, the bearing stand 11 has different material thicknesses in some sections; in a central region of the bearing stand 11, there is a maximum material thickness that is formed by bridges pieces 12 on opposite sides (only one of which is shown in FIG. 1) because the bridge pieces 12 are slightly raised relative to the remaining regions of the bearing stand 11. In the assembled state, a clipped-on middle applicator element 5*a* is fastened in the region of the bridge pieces 12 in a rigid fashion or essentially without play, in any case so that it is unable to pivot significantly around the axis S. In the remaining regions of the bearing stand 11 in which the first outer applicator element 5*b* and the second outer applicator element 5*c* are mounted in the assembled state, the applicator elements 5*b* and 5*c* are able to pivot around the pivot axis S to a limited degree.

The control element 3, which is embodied as a sliding sleeve, is supported on the distal end of the holding region 2*a*. The control element 3 has guide surfaces 13 on the inside (see FIG. 3), which rest against flat sides 14 of the sliding tube 2*b*, and the control element is thus supported so that it can slide along the longitudinal direction L relative to the grip piece 2. In the region of a proximal end 15 of the sliding tube 2*b* at least one detent notch 16 or a plurality of them is/are provided, in which detent lugs (not shown) of the control element 3 can engage in detent fashion at different positions of the sliding path along the longitudinal axis L, thus permitting the control element 3 to be fixed in detent fashion in predetermined positions relative to the grip piece 2.

In the region of a distal end 17 of the control element 3, the control element has a groove 18 on the inside, in which a corresponding bead 19 of the slider 4 is supported so that it is immobilized axially, i.e. in the longitudinal direction L. The slider 4 has an essentially cup-shaped three-dimensional form and essentially closes an opening of the control element 3 at its distal end. The slider 4 has a rotating collar 20, which in the assembled state of applicator 1, protrudes beyond the outer contour composed of the holding region 2*a*, the control element 3, and the remaining outer surface of the slider 4.

The essentially cup-shaped slider 4 has a bottom 21; a molded opening 22 is situated in the bottom 21 and is embodied so that the applicator elements 5*a*, 5*b*, 5*c*, as a packet of fan slats constituting the applicator device 5, can be inserted through the molded opening 22 for assembly. In the assembled state, the molded opening 22 supports and guides the applicator elements 5*a*, 5*b*, 5*c* without play or with a small amount of play. In the region of two boundary edges of the molded opening 22, actuating tabs 23*b* and 23*c* protrude a short distance into the molded opening 22. In the assembled state of the applicator 1, the actuating tabs 23*b* and 23*c* cooperate with corresponding actuating grooves 24*b* and 24*c* in the applicator elements 5*a*, 5*c* (see FIG. 3) and protrude a short distance into them, preferably with a little play. Extending distally from the collar 20, the slider 4 has an outer circumferential surface 25, which can cooperate in a sealed fashion with a stripper of a cosmetic device.

Figures 4A, 4B, 4C:
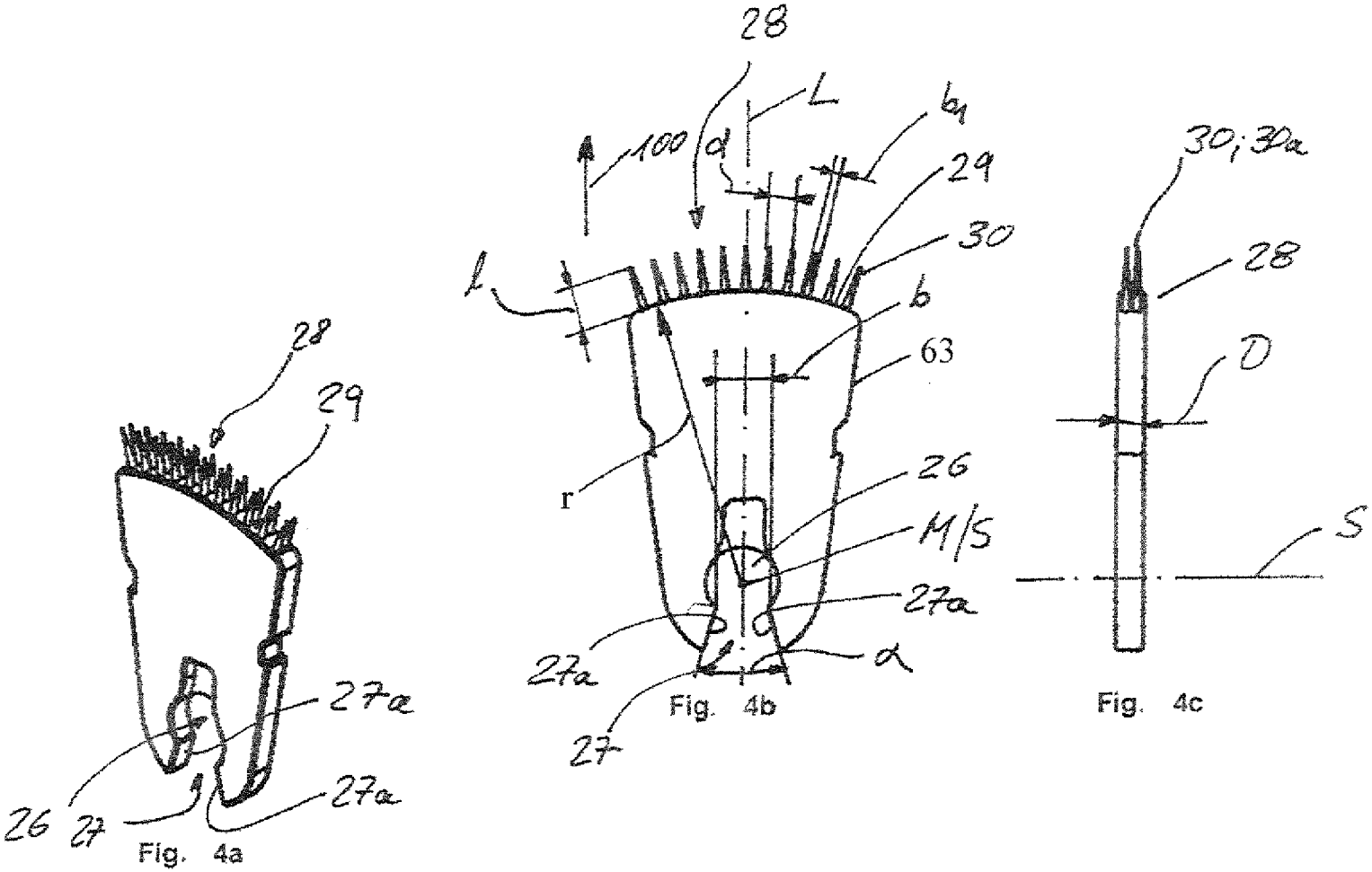
FIG. 4*a* is an isometric view of an applicator element of an applicator according to the invention.
FIG. 4*b* is a front view of the applicator element according to FIG. 4*a;*
FIG. 4*c* is a side view of the applicator element according to FIGS. 4*a* and 4*b;*
Figure 5:
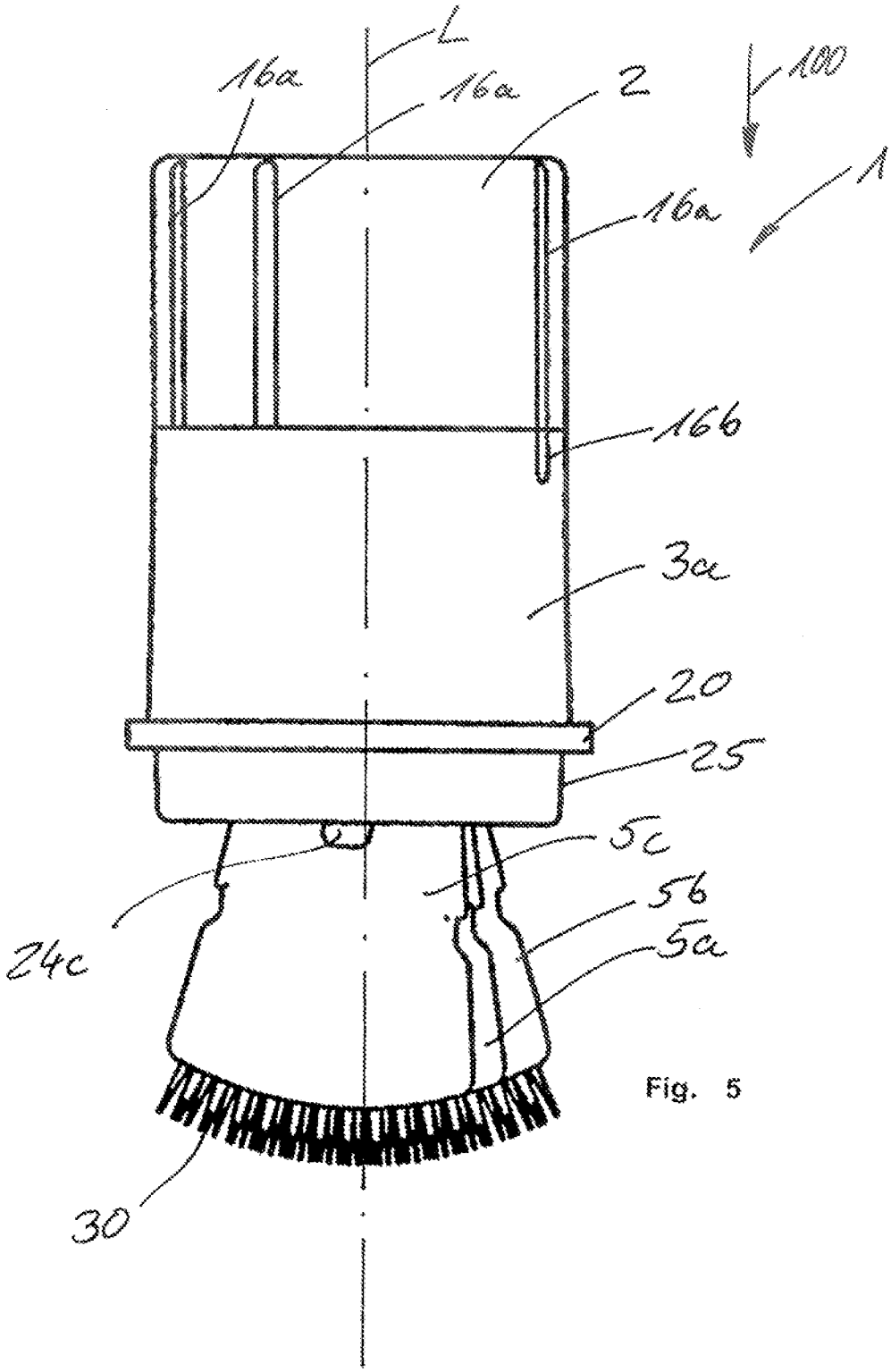
FIG. 5 is a front view of a second embodiment of an applicator according to the invention.

In the present exemplary embodiment, the fan-like applicator device 5 is composed of three structurally identical applicator elements 5*a*, 5*b*, 5*c* with at least partially overlapping flat sides. The applicator elements 5*a*, 5*b*, 5*c* have an essentially plate-shaped three-dimensional form. To support the applicator elements 5*a*, 5*b*, 5*c* on the bearing axle 10, in the region of a proximal end of the applicator elements 5*a*, 5*b*, 5*c*, the applicator elements 5*a*, 5*b*, 5*c* each have a respective bearing recess 26. The diameter of the bearing recess 26 is matched to the diameter of the bearing axle 10 so that at least the applicator elements 5*b*, 5*c* can be slid or clipped onto the bearing axle 10, preferably without play or with a slight play, but in any case so that they are able to pivot. At the proximal end of the applicator elements 5*a*, 5*b*, 5*c*, the bearing recess 26 has a slot opening 27 that has stop edges 27*a* and opens out in a wedge shape toward the proximal end and, with regard to its opening angle α (see FIG. 4*b*) as well as its internal width b (see FIG. 4*b*), is matched to the diameter of the bearing axle 10 and the geometric shape of bearing structure 9 in a way that permits the outer applicator elements 5*b* and 5*c* to execute a pivoting motion around the pivot axis S in both pivoting directions until one of the stop edges 27*a* of the slot opening 27 rests against a side surface of the bearing stand 11.

The stop edges 27*a* of the slot opening 27 are also matched to the bearing stand 11, in particular matched to the geometric three-dimensional form of the bridge pieces 12 so that the middle applicator element 5*a* is supported without play or almost without play against the outer front surfaces of the bridge pieces 12 and thus in a rigid fashion, i.e. so that it cannot pivot or can only pivot to an insignificant degree, around the axle 10 on the grip piece 2.

In the region of a distal end 28 of the applicator elements 5*a*, 5*b*, 5*c*, the applicator elements 5*a*, 5*b*, 5*c* have a curved front surface 29 (see FIGS. 1 through 3 and 4*b*). A curvature radius r preferably corresponds to the distance of the front surface 29 from a center point M of the bearing recess 26, which distance can essentially be freely selected, but is preferably from 5 mm to 100 mm, in particular from 10 mm to 80 mm. Radiating out in the distal direction from the curved front surface 29, there are a plurality of bristles 30, which in a particularly preferred embodiment are each integrally connected to the applicator elements 5*a*, 5*b*, 5*c*. The bristles 30 are therefore preferably embodied in the form of bristles that are injection molded in place. The applicator elements 5*a*, 5*b*, 5*c* and the bristles 30 can thus be embodied as a single-component injection-molded part made from one and the same plastic material. Naturally, multi-component injection-molded parts, in particular two-component injection-molded parts, are also possible in which the integrally connected bristles 30 are made of a softer material than the rest of the applicator elements 5*a*, 5*b*, 5*c*. In particular, this makes it possible to mold relatively softer or harder bristles 30 onto an applicator element, advantageously influencing the application result.

In the present exemplary embodiment, the front surface 29 of each respective applicator element 5*a*, 5*b*, 5*c* has one row of single or double bristles 30, with two adjacent bristles 30 of the parallel bristle rows 30*a*, 30*b*, 30*c* being aligned with each other in a direction parallel to the direction 101.

In the present case, the bristles 30 have a pointed cone-shaped three-dimensional form, and the length l of the bristles corresponds to approximately 3 to 20 times the thickness $b_1$ at the foot of the bristle. The bristles point in the radial direction, radiating out in the distal direction from the center point M of the bearing recess 26, with the center lines of two adjacent bristles 30 enclosing an angle β in a top view of the applicator elements 5*a*, 5*b*, 5*c* according to FIG. 9*a*. The angle β in the exemplary embodiment is about 5°, but preferably lies in the range $3° \leq \beta < 15°$, particularly $3° \leq \beta < 10°$. This results in a distance between two adjacent bristles 30 of about 1 mm to 5 mm, measured between the tips of the two adjacent bristles 30. The distance between two adjacent bristles of one and the same applicator element 5*a*, 5*b*, or 5*c* corresponds to the maximum possible effective bristle spacing $d_{WMax}$.

A pocket-like depression, which forms the actuating grooves 24*b* and 24*c*, extends distally away from the bearing recess 26 toward the free front surface 29.

To form an applicator device 5, three preferably identical applicator elements 5*a*, 5*b*, 5*c* are provided in the exemplary embodiment and are placed against one another preferably with their flat sides overlapping so as to create a kind of fan slat packet of applicator elements 5*a*, 5*b*, 5*c*; the bearing recesses 26 of the applicator elements 5*a*, 5*b*, 5*c* are aligned with one another and there is an angular offset between adjacent applicator elements 5*c* and 5*a* or 5*a* and 5*b*, which offset in particular corresponds to two times the value of the angle β.

It should be noted here merely by way of explanation that in the exemplary embodiment, the fan slat packet is composed of three identical applicator elements 5*a*, 5*b*, 5*c*. The scope of the invention naturally also includes a fan slat packet composed of applicator elements 5*a*, 5*b*, 5*c* that differ from one another with regard to either their geometric three-dimensional form or their material. This alone constitutes a significant advantage of the invention since different configurations of fan slat packets composed of different or identical applicator elements 5*a*, 5*b*, 5*c* can be used to produce different application properties, which can be easily adapted to different customer requirements or, where appropriate, also to different production requirements. For example, bristles 30 of the applicator elements 5*a*, 5*b*, 5*c* can have a different hardness or elasticity so that some of the bristles 30 of the applicator 1, for example, are harder than others.

The two outer applicator elements 5*c* and 5*b* therefore have an angular offset from one another on the order of 4 times the value of the angle β. The boundary edges 27*a* of the slot openings 27 here are dimensioned and chosen in their arrangement so that a stop edge 27*a* of the slot opening 27 of the applicator element 5*c* rests against a first side of the bearing stand 11. The opposite stop edge 27*a* therefore has clearance relative to the opposite side surface of the bearing stand 11. The stop edges 27*a* of the slot opening 27 of the middle applicator element 5*a* rest against the free front surfaces of the bridge pieces 12 so that the middle applicator element 5*a* is connected to the grip piece 2 in an essentially rigid fashion, in any case so that it is not able to pivot significantly around the pivot axis S. In the exemplary embodiment, the initial position of the second outer applicator element 5*c* corresponds approximately to the other extreme pivoting position of the above-described applicator element 5*c*.

In the following, therefore, the above-described fan-like applicator device 5 is understood to be in a starting position that corresponds to that of the above-described packet of fanned-out applicator elements 5*a*, 5*b*, 5*c*.

An applicator according to the invention shown in FIGS. 1 through 3 can be assembled as follows.

The control element 3 is first slid onto the sliding tube 2*b* of the grip piece 2 until the detent lug, not shown, engages in detent fashion in one of detent notches 16. Then, the slider 4 is slid into the control element 3 in the direction opposite the longitudinal direction 100. As an alternative, it is naturally also possible to preassemble the control element 3 and slider 4 and to slide the actuating device 6 as a whole onto the sliding tube 2*b* of the grip piece 2. In this state, a preconfigured packet of fanned-out applicator elements 5*a*, 5*b*, 5*c* is guided in the direction opposite from the direction 100 by means of the molded opening 22 so that the actuating tabs 23 come into engagement with the actuating grooves 24*b* and 24*c* of the outer applicator elements 5*b* and 5*c*. The packet of applicator elements 5*a* to 5*c* is thus slid through the molded opening 22 until the applicator elements 5*a* through 5*c* are fixed in place by being clipped onto the bearing axle 10. The outer applicator elements 5*b* and 5*c* thus come to rest in the region next to the bridge pieces 12 of the bearing stand 11 so that the outer two applicator elements 5*b* and 5*c* are able to pivot a short distance back and forth around the pivot axis S. The middle applicator element 5*a* comes to rest against the bearing structure 9 so that the stop edges 27*a* of the slot opening 27 cooperate with the free front surfaces of the bridge pieces 12 and the middle applicator element 5*a* is fixed in position so that it cannot pivot or almost cannot pivot, around the axis S relative to the bearing structure 9 and thus relative to the grip piece 2. At this stage, the applicator is completely assembled.

Axially moving the control element 3, e.g. in the direction of the longitudinal axis L, causes the slider 4 to move along with it for the same distance in the axial direction, as a result of which the actuating tabs 23*b* and 23*c* move in the corresponding actuating grooves 24*c* and 24*b* and cooperate with the edges of the actuating grooves 24*b* and 24*c* so that the outer applicator elements 5*b* and 5*c* execute a pivoting motion relative to the longitudinal axis L as a function of the axial sliding motion of the control element 3 and slider 4 in the longitudinal direction 100. When the control element 3 is slid opposite the longitudinal direction 100, the sequence is reversed because the actuating tabs 23*c* and 23*b* cooperate with the other boundary edges on the opposite side of the actuating grooves 24*b* and 24*c* and as a result, the outer applicator elements 5*b* and 5*c* are pivoted in a positively guided fashion in an opposite pivoting direction oriented away from the longitudinal axis L.

The description below focuses on the differently fanned positions of the applicator elements 5*a*, 5*b*, 5*c* relative to one another and on the resulting effects achieved when applying mascara compound, for example to eyelashes.

Figure 9A:
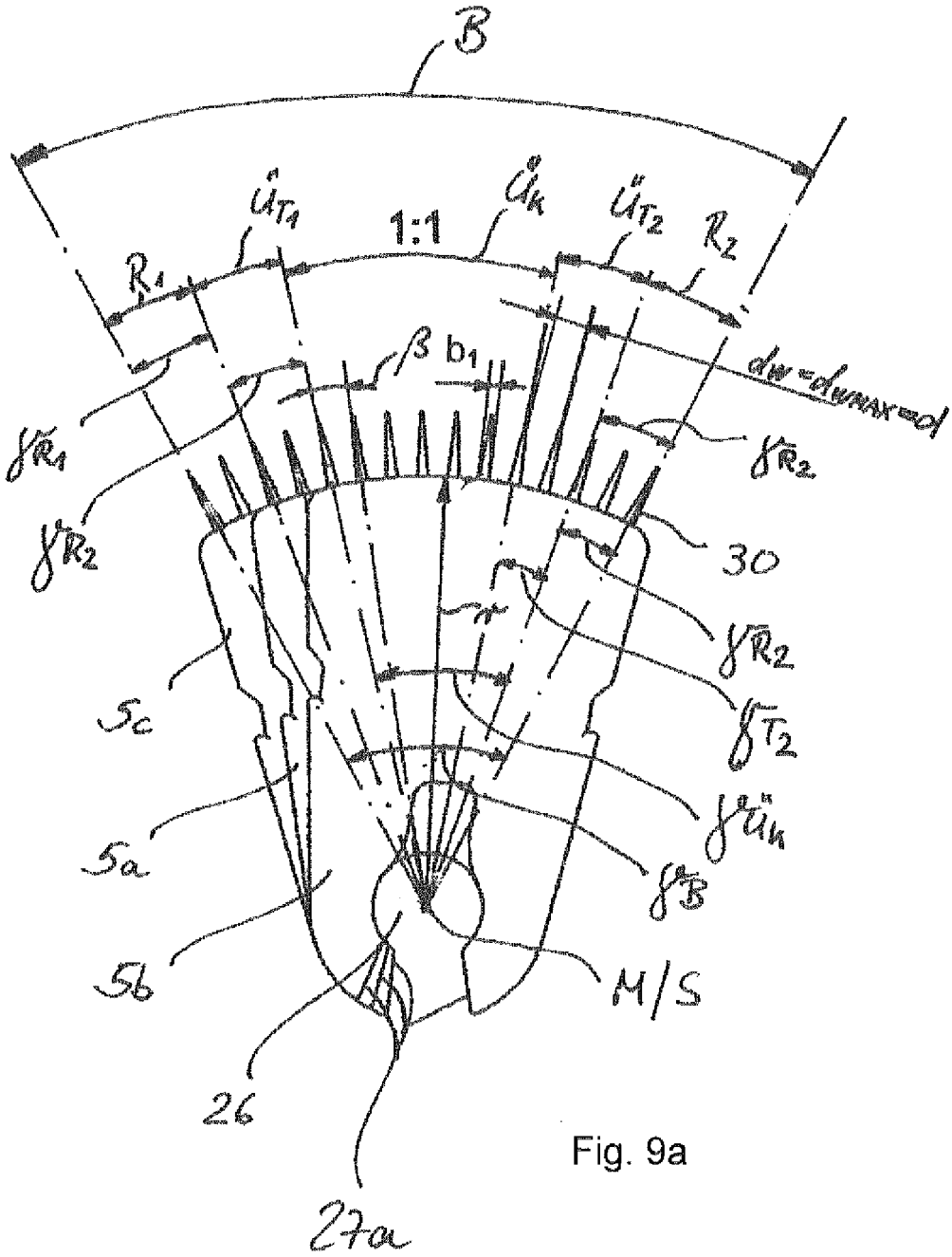
FIG. 9*a* is a front view of an applicator device with applicator elements arranged in a fan, in a maximally fanned-out position with an effective bristle spacing $d_{WMax}$.
Figure 9B:
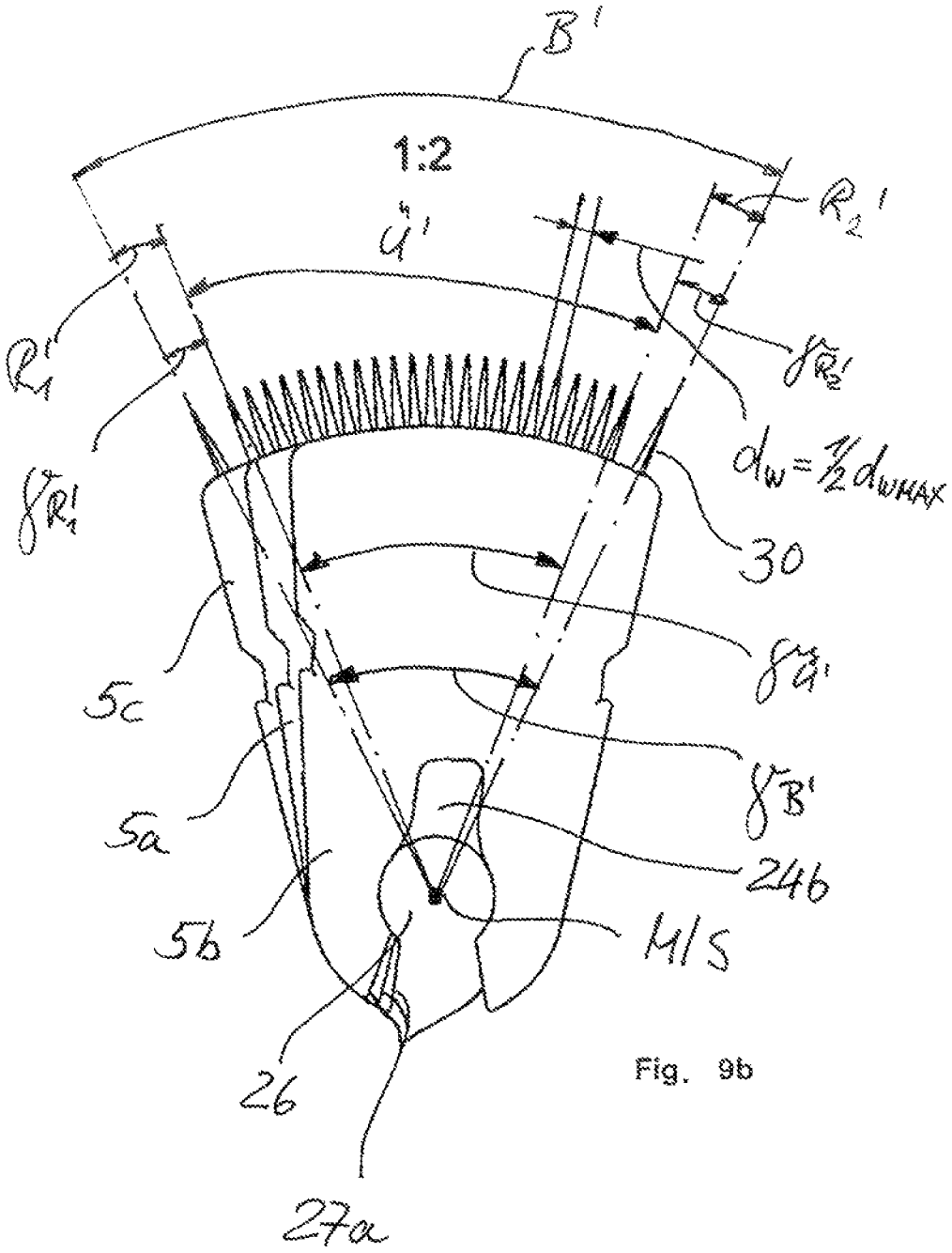
FIG. 9*b* is a front view of the applicator device according to FIG. 9*a* in a first, narrower folded-in position with an effective bristle spacing of ½ $d_{WMax}$.
Figure 9C:
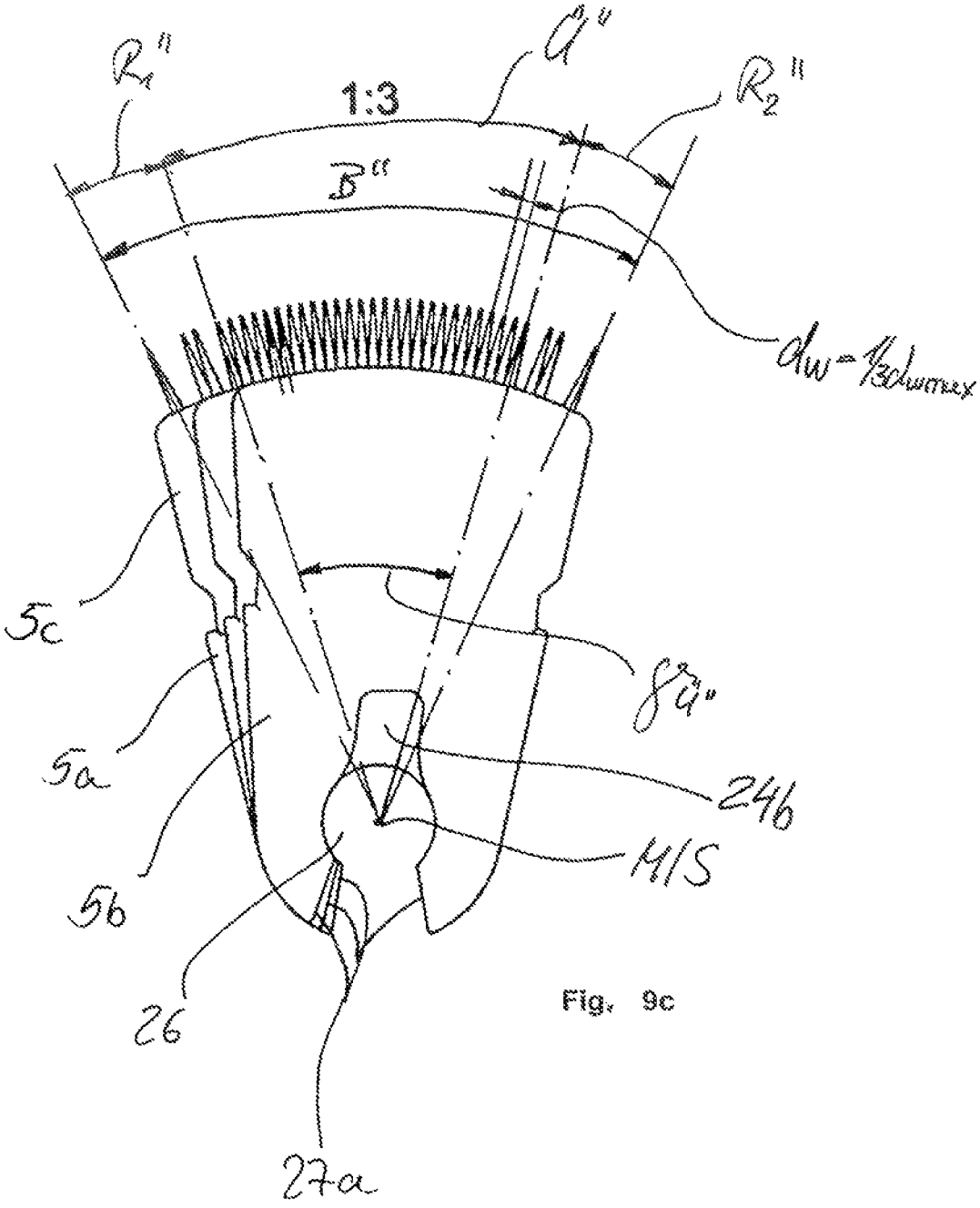
FIG. 9*c* shows the applicator device according to FIG. 9*a* in a second, narrowest folded-in position with an effective bristle spacing of ⅓ $d_{WMax}$.

In FIG. 9*a*, the applicator elements 5*a*, 5*b*, 5*c* are shown in the maximally fanned-apart position. The viewing direction, i.e. the projection direction of FIGS. 9*a*, 9*b*, and 9*c*, is perpendicular to the plane of the drawing and thus perpendicular to the plane of the plate-shaped applicator elements 5*a*, 5*b*, 5*c*.

In a maximally fanned-open first fan position of the applicator elements 5*a*, 5*b*, 5*c* according to FIG. 9*a* the middle, fixed applicator element 5*a* is oriented so that it is aligned approximately symmetrical to the longitudinal axis L. Compared to the middle applicator element 5*a*, the first outer applicator element 5*b* is pivoted to the right (clockwise) in the view in FIG. 9*a*, by two times the angle β. The second outer applicator element 5*c*, which is the lowest applicator element in the depiction in FIG. 9*a*, is situated in a position in which it is pivoted counterclockwise, i.e. to the left, in FIG. 9*a* relative to the middle, fixed applicator element 5*a* by two times the angle β. This forms a core overlap region $Ü_K$, in which bristles 30 of all three applicator elements 5*a*, 5*b*, 5*c* lie; the bristles 30 of the applicator elements 5*a*, 5*b*, 5*c* in a projection direction perpendicular to the plane of the drawing in FIG. 9*a* are aligned with one another and are arranged one behind the other in three rows or three double rows 30*a*, 30*b*, 30*c*. The bristles 30 of one and the same applicator element 5*a*, 5*b*, 5*c* have an effective bristle spacing $d_W$ from one another that corresponds to the maximum bristle spacing $d_{WMax}$. Because all of the bristles 30 of all of the applicator elements 5*a*, 5*b*, 5*c* are aligned with one another in the core overlap region $Ü_K$, no effective reduction of the effective maximum bristle spacing $d_{WMax}$, takes place.

Partial overlap regions $Ü_{T1}$ and $Ü_{T2}$ adjoin the edge of the core overlap region $Ü_K$. In the depiction in FIG. 9, the partial overlap region $Ü_{T1}$ is composed of bristles 30 of the middle applicator element 5*a* and the second outer applicator element 5*c*. The bristles 30 of these two applicator elements 5*a*, 5*c* are aligned with each other in a projection direction perpendicular to the plane of the drawing according to FIG. 9*a* so that the maximum achievable effective bristle spacing $d_{WMax}$ is also present within the partial overlap region $Ü_{T1}$.

The same applies in corresponding fashion to the partial overlap region $Ü_{T2}$ that is composed exclusively of the bristles 30 of the middle applicator element 5*a* and the first outer applicator element 5*b*. Otherwise, everything that has been said about the partial overlap region $Ü_{T1}$ applies in corresponding fashion to the partial overlap region $Ü_{T2}$.

Edge regions $R_1$ and $R_2$ adjoin the edges of the partial overlap regions $Ü_{T1}$ and $Ü_{T2}$. The edge regions $R_1$ and $R_2$ are composed exclusively of the bristles 30 of one of the outer applicator elements 5*b* or 5*c*. In the depiction in FIG. 9*a*, the edge region $R_1$ is composed of bristles 30 of the second outer applicator element 5*c* while the edge region $R_2$ is composed exclusively of bristles 30 of the first outer applicator element 5*b*.

All of the above-described regions, i.e. the core overlap region $Ü_K$, the partial overlap regions $Ü_{T1}$ and $Ü_{T2}$, and the edge regions $R_1$ and $R_2$, constitute a bristle field B. The bristle field B has a sector angle $\gamma_B$ that preferably lies in the range $20° \leq \gamma_B < 90°$. The sector angle $\gamma_{ÜK}$ of the core overlap region $Ü_K$ depends on the number of bristles 30 within the overlap region $Ü_K$ and is a multiple of the angle β. In the exemplary embodiment, it is 6 times the angle β, but can also suitably lie in a range from 2 times to 20 times 13, in particular from 2 to 15 times β. In the exemplary embodiment, the sector angles $\gamma_{T1}$ and $\gamma_{T2}$ of the partial overlap regions $Ü_{T1}$ and $Ü_{T2}$ are each two times the angle β. The same applies to the sector angles $\gamma_{R1}$ and $\gamma_{R2}$, which are the sector angles of the edge regions $R_1$ and $R_2$. The maximum fanned-out position of the applicator elements 5*a*, 5*b*, 5*c* according to FIG. 9*a* is characterized by the fact that across the entire bristle field B, the effective bristle spacing $d_w$ between all of the bristles 30 in a projection perpendicular to the plane of the applicator elements 5*a* to 5*c* corresponds to the maximum effective bristle spacing $d_{WMax}$. The maximum effective bristle spacing $d_{WMax}$ is therefore structurally determined by the spacing d between the individual bristles 30 on the front surface of each of the applicator elements 5*a*, 5*b*, 5*c*. In the exemplary embodiment, this distance is approx. 2 mm and preferably lies between 1 mm and 5 mm so that the distance $d_w$ is large enough to catch a plurality of eyelashes and bundle them as mascara is being applied. In this maximally fanned-out position, the fan applicator according to the invention is particularly suitable for increasing the volume of the eyelashes to be treated by applying mascara compound to them with the applicator 1 and for achieving the often desired so-called volumizing effect in the make-up/application result. A corresponding detent notch 16 for the control element 3 is associated with this maximally fanned-out position of the applicator elements 5*a*, 5*b*, 5*c* according to FIG. 9*a* so that the applicator elements 5*a*, 5*b*, 5*c* can be releasably fixed in this position, in particular by means of detent engagement. It is possible to slide the control element 3 from the position shown in FIG. 9*a*, causing the applicator elements 5*a*, 5*b*, 5*c* to be moved into a narrower folded-in position shown in FIG. 9*b*. This first, narrower folded-in position shown in FIG. 9*b* will be described below.

To reach the position shown in FIG. 9*b* starting from the position shown in FIG. 9*a*, the first outer applicator element 5*b* is pivoted counterclockwise around the pivot axis S by half the angle β. When this happens, the second outer applicator element 5*c* pivots around the pivot axis S by half the angle β in the opposite direction. In this position, the sector angle $\gamma_{B'}$ of the entire bristle field B' is therefore smaller by the value of the angle β than in a position shown in FIG. 9*a*. In this movement, the bristles 30 of the outer applicator elements 5*b* and 5*c* are shifted by pivoting until they come to rest centered between two bristles 30 of the middle applicator element 5*a* in a projection direction perpendicular to the applicator elements 5*a*, 5*b*, 5*c*. As a result, the effective bristle spacing $d_W$ for the application of mascara is reduced to half the value $d_{WMax}$ ($d_W = ½\, d_{WMax}$) so that the effective bristle spacing $d_W$ that is essential for the application result is only half as large as the maximum effective bristle spacing $d_{WMax}$ over a wide region Ü' of the bristle field B'. With the arrangement according to the invention, this can be successfully achieved in a bristle field region Ü' with a sector angle $\gamma_{Ü'}$. Edge regions $R'_1$ and $R'_2$ adjoin the edges of the bristle field region Ü'. They each have a sector angle $\gamma_{R1'}$ and $\gamma_{R2'}$, respectively, that is equal to the angle β.

The halving of the effective bristle spacing $d_{WMax}$ in a position shown in FIG. 9*b* achieves satisfactory results in terms of the volumizing effect in the application of mascara and also achieves a separation of the eyelashes that is increased compared to the position shown in FIG. 9*a*. A corresponding detent notch 16 for the control element 3 is also suitably associated with the control element 3 in the position of the applicator elements 5*a* to 5*c* shown in FIG. 9*b* so that the applicator elements 5*a* to 5*c* can be releasably fixed in detent fashion in this position.

Starting from the position shown in FIG. 9*b*, the outer applicator elements 5*b* and 5*c* can each be pivoted a short distance farther in their respective pivoting directions in the counterclockwise (applicator element 5*b*) and clockwise (applicator element 5*c*) directions, in particular by another sixth of the angle β, so that starting from the starting position shown in FIG. 9*a*, the first outer applicator element 5*b* is pivoted by an angle amounting to a total of ⅔ of the value of the angle β counterclockwise and the second outer applicator element 5*c* is pivoted by an angle amounting to a total of ⅔ of the angle β clockwise. This position is shown in FIG. 9*c*. This position is characterized by the fact that over a wide bristle field region Ü", the effective bristle spacing $d_W$ amounts to only ⅓ the value of $d_{WMax}$ in a projection perpendicular to the plane of the applicator elements 5*a* to 5*c*. The corresponding sector angle $\gamma_{Ü''}$ in this case is 8.666 times the angle β. Within this bristle region Ü", this effective bristle spacing is a continuous $d_W = ⅓\, d_{WMax}$. The edge regions of $R''_1$ and $R''_2$ adjoin the bristle region Ü" at its edges. The effective bristle spacings $d_W$ within the edge regions of $R''_1$ and $R''_2$ are ⅓ $d_{WMax}$ and ½ $d_{WMax}$. However, in this position, these regions are of secondary importance for the application result. In the position shown in FIG. 9*c*, i.e. with an effective bristle spacing $d_W$ of ⅓ $d_{WMax}$ within a bristle region Ü", in particular a high degree of separation is achieved for the eyelashes being provided with mascara compound because the very narrow effective bristle spacing $d_W$ practically rules out the occurrence of a bundling of the lashes of the kind that is desirable for achieving the volumizing effect in a position shown in FIG. 9*a*. Instead, a combing separation of the eyelashes takes place so that a good separating result can be achieved.

A corresponding detent notch 16 for the control element 3 is also suitably associated with this position of the applicator elements 5*a* to 5*c* so that this position according to FIG. 9*c* can also be fixed in detent fashion.

In order to be able to achieve the above-described fan positions according to FIGS. 9*a*, 9*b*, and 9*c*, it is advisable to embody the bristle geometry as follows. The bristles 30 are embodied primarily in the shape of pointed cones or wedges and have a diameter or thickness $b_1$ in the region of a bristle base, i.e. in the region in which the bristle 30 is connected to the front edge 29 of the plate-shaped applicator element 5*a*, 5*b*, 5*c*. When there are n applicator elements, the value for $b_1$ is preferably slightly smaller than the nth part of the maximum effective bristle spacing $d_{WMax}$. This choice for $b_1$ makes it possible in a position shown in FIG. 9*c* to achieve the effective bristle spacing of ⅓ $d_{WMax}$ without the bristles 30 overlapping in the base region. This makes it possible to achieve a maximum comb depth, i.e. to permit eyelashes to travel to the bottom or almost to the bottom between two adjacent bristles 30. If the value for $b_1$ is chosen to be slightly larger, then in a position shown in FIG. 9*c*, overlaps occur in the base region of the bristles so that the interstices between two bristles, which are situated next to each other with the spacing ⅓ $d_{WMax}$, become smaller and thus eyelashes can no longer travel as far down between the bristles 30 during application. A preferable value for $b_1$ has turned out to be from $0.2\times d_{WMax}$ to $0.4\times d_{WMax}$. A range from $0.2\times d_{WMax} \leq b_1 < 0.3\times d_{WMax}$ is particularly suitable.

In the exemplary embodiment described above, the free front surface 29 of each applicator element 5*a*, 5*b*, 5*c* has 11 bristles that are spaced equidistantly along the curved front surface 29. The scope of the invention naturally also includes providing a larger or smaller number of bristles 30; the applicator elements 5*a*, 5*b*, 5*c* can have a different number of bristles. The above-described arrangements of bristles 30 with a maximum effective distance $d_{WMax}$ according to FIG. 9*a*, with ½ $d_{WMax}$ according to FIG. 9*b*, and with ⅓ $d_{WMax}$ according to FIG. 9*c* can be easily achieved in an uncomplicated way with the described embodiment. By no means, however, does this exclude other bristle sets of the applicator elements 5*a*, 5*b*, 5*c*. In particular, the bristles 30 of the applicator elements 5*a*, 5*b*, 5*c* can also be equipped with bulges, in particular drop-shaped bulges, at their free distal bristle ends.

In the exemplary embodiment shown, the bristles 30 radiate out from the applicator element 5*a*, 5*b*, 5*c* directly from the center point M and taper toward their distal ends. As an alternative, the bristles 30 of the applicator elements can also be embodied with a curvature. In bristles of the outer applicator elements 5*b* and 5*c*, such a curvature can be oriented, for example, so that they are curved toward the bristles 30 of the middle applicator element 5*a*. As a result, the application behavior of the applicator can in particular approximate one in which all of the bristles are situated in a central plane, for example in the plane of the applicator element 5*a*.

A thickness D of the applicator elements 5*a* to 5*c* should be chosen to be as small as possible so that a distance of bristle rows 30*a*, 30*b*, 30*c* from one another (see FIG. 3) can be embodied to be as small as possible. With a double-row bristle set per applicator element 5*a*, 5*b*, 5*c*, as shown in FIG. 3, a plate thickness D of 1 mm to 2 mm, in particular 1.4 mm to 1.8 mm, has proven useful. The thickness D can be further reduced with a single-row bristle set. In particular, a thickness range from 0.7 mm to 1.4 mm, especially from 0.7 mm to 1.0 mm, has proven useful.

A second embodiment of an applicator according to the invention will be described below in conjunction with FIGS. 5 through 8. With regard to the operating principle of the fan, the second embodiment of the applicator 1 according to the invention is based on the above-mentioned characteristics and properties of the first embodiment of the applicator, so that descriptions of them are not repeated here. Statements made above also apply to the second embodiment of the applicator. The second embodiment of the applicator 1 differs only with regard to the actuating mechanism; the sliding mechanism composed of the slider 4 and control element 3 from the first embodiment of the applicator has been replaced by a rotating mechanism. This is described in detail below. For the description, components with same function are provided with the already-established reference symbols.

In addition to the sliding tube 2*b*, the grip piece 2 of the applicator 1 according to FIGS. 5 through 8 has a threaded section 2*c*, which is situated after the grip piece 2 in the axial direction 100. The sliding tube 2*b* is situated axially after the threaded section 2*c* in the longitudinal direction 100. The slider 4 which has a sliding sleeve 50 with which the slider 4 is slid onto the outside of the sliding tube 2*b* and is supported so that it can be slid axially in the direction of the longitudinal axis 100 relative to the grip piece 2. In addition, a rotating control element 3*a* is provided, which cooperates with a thread 51 of the threaded section 2*c*. The rotating control element 3*a* is supported so that it can be rotated around the longitudinal axis L relative to the grip piece 2. At the distal end of the rotary control element 3*a*, the rotary control element 3*a* is inserted into a corresponding recess in the slider 4 and is supported so that it is also able to rotate around the axis L relative to the slider 4 and can be moved axially by means of the thread 51. In lieu of the detent notches 16 of first exemplary embodiment, there are visible marks 16*a* on the cylindrical outside of the grip piece 2. A counterpart mark 16*b* corresponding to the visible marks 16*a* is situated on the cylindrical outside of the rotary control element 3*a*. If the counterpart mark 16*b* of the rotating control element 3*a* is rotated to one of the visible marks 16*a*, i.e. the marks 16*a* and 16*b* are brought into alignment, then this corresponds to one of the respective fan positions according to FIGS. 9*a* to 9*c*.

Figure 6:
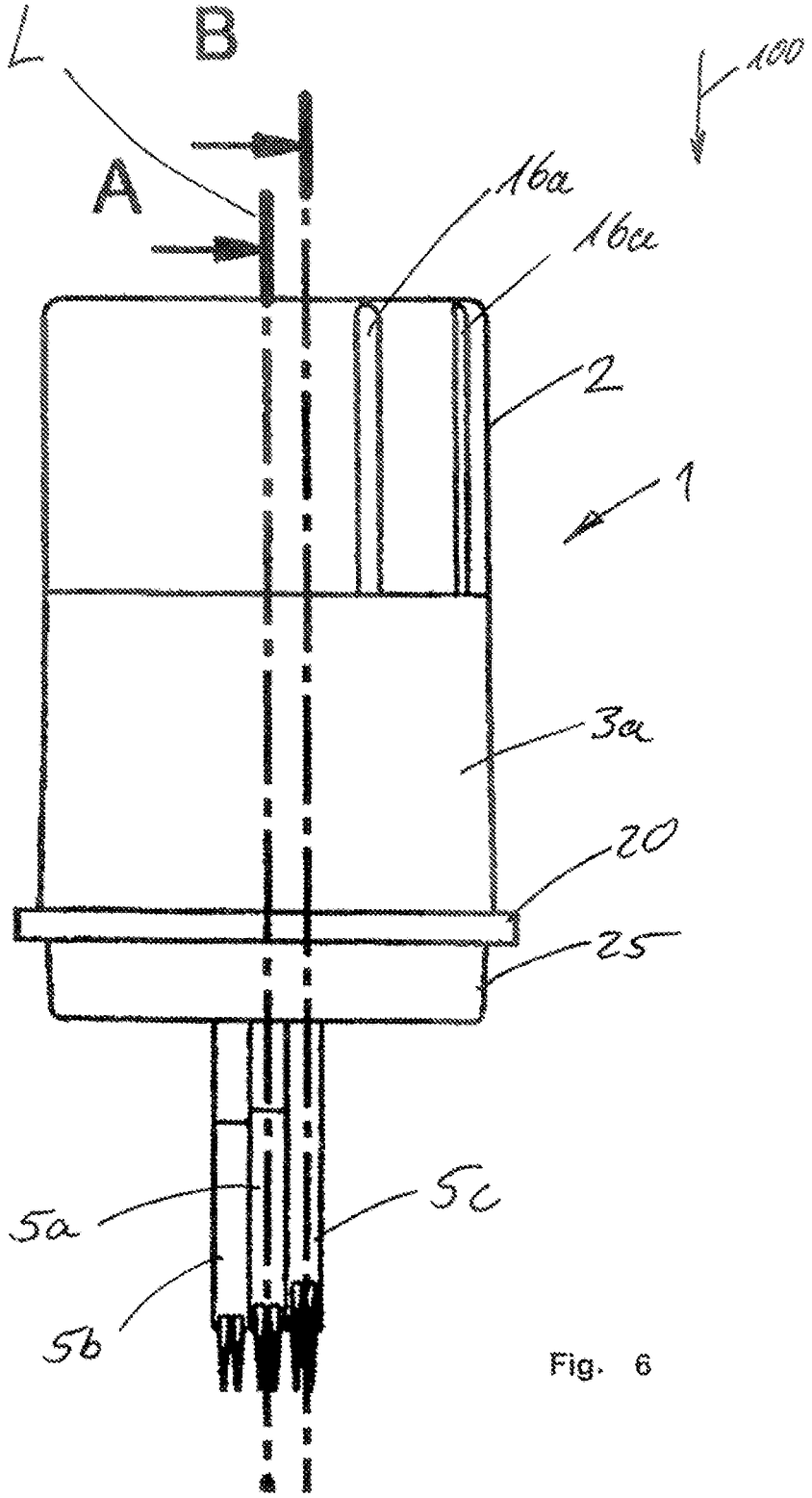
FIG. 6 is a side view of the applicator according to FIG. 5.
Figure 7:
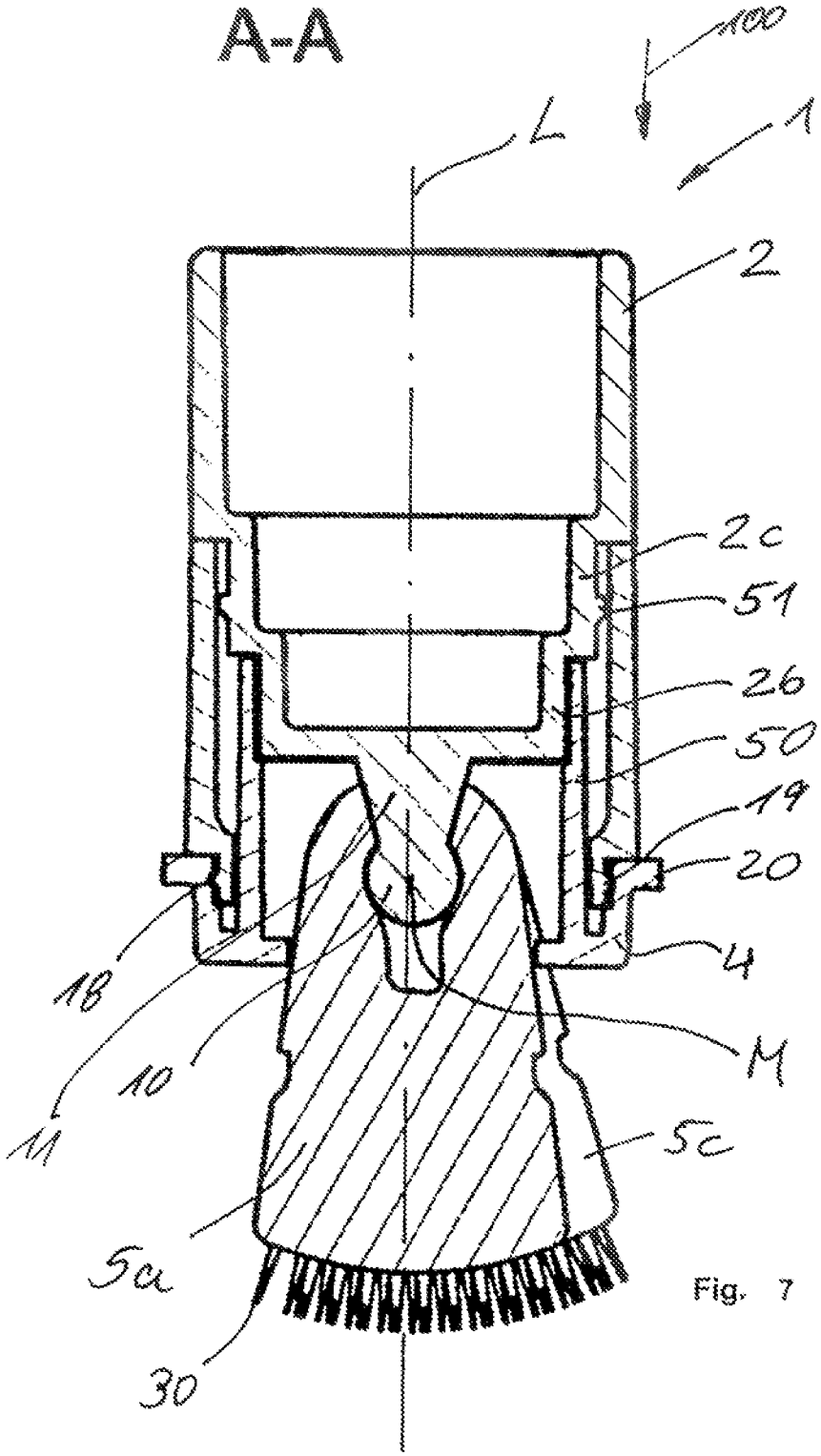
FIG. 7 is a longitudinal section through the applicator according to FIG. 6 along the line A-A.

It is particularly clear from the sectional depiction in FIG. 7, which corresponds to a central longitudinal section along the line A-A from FIG. 6, that as in the first exemplary embodiment, the middle applicator element 5*a* is supported in form-locked, non-pivoting fashion on the bearing structure 9, in particular on the bearing axle 10, and the bridge pieces 12 of the bearing stand 11 prevent the middle applicator element 5*a* from pivoting.

Figure 8:
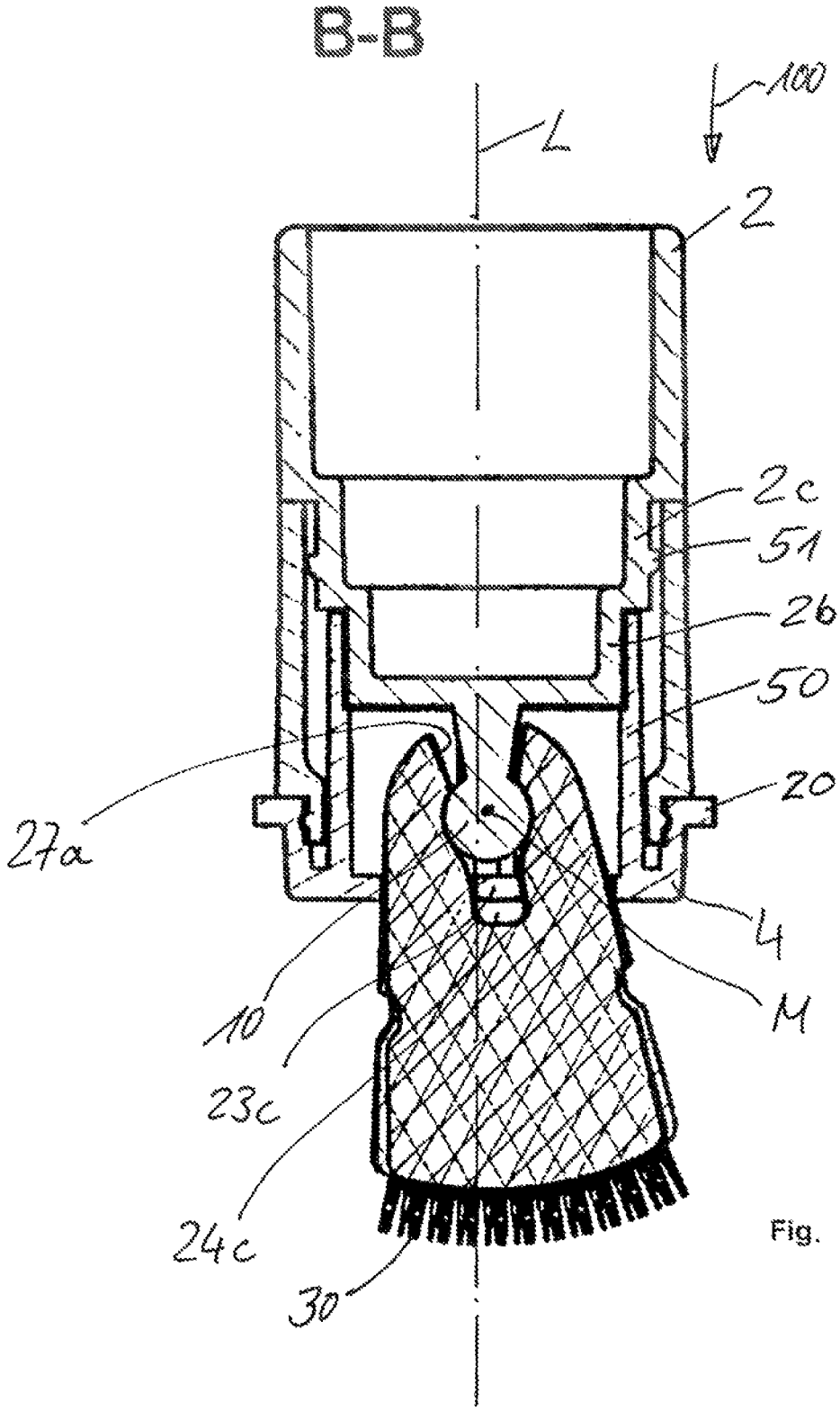
FIG. 8 is a longitudinal section through the applicator according to FIG. 6 along the line B-B.

By contrast, the second outer applicator element 5*c*, as shown in FIG. 8, is able to move in a pivoting range around the bearing axle 10 because in the region of the bearing structure 9 in which the outer applicator element 5*b* and the second outer applicator element 5*c* are supported, the bearing stand 11 is embodied as thinner (where it has no bridge pieces 12). This produces a pivoting mobility that is sufficient for the fan-like adjustability with which the applicator is provided according to the invention. Otherwise, the actuating mechanism of the second exemplary embodiment according to FIGS. 5 through 7 corresponds to that of the first exemplary embodiment. The actuating tabs 23*b* and 23*c* engage in actuating grooves 24*b*, 24*c* of the outer applicator elements 5*b* and 5*c* so that an axial sliding of the slider 4, which is generated by a rotation of the rotating control element 3*a* in this exemplary embodiment, causes a change in the degree to which the applicator elements 5*a* to 5*c* are fanned out relative to one another. Like the slider of the first exemplary embodiment, this rotating mechanism of the second exemplary embodiment involves a positive guidance of the outer applicator elements 5*c* and 5*b* in both pivoting directions since both a fanning-out and a folding-in of the applicator elements in relation to one another takes place with positive guidance relative to one another, particularly in a form-locked fashion by means of a tab/groove combination.

On the other hand, it is also conceivable to use actuating mechanisms that are positively guided in one direction only. To this end, for example, spring elements 60 (see FIGS. 10 and 11) can be provided by means of which the applicator elements are pressed elastically, i.e. in a force-loaded way, into a predetermined starting position. In the embodiment according to FIG. 10, the elastic element 60 is linked to the applicator element 5*a*, 5*b*, or 5*c* and is supported elastically against a bottom 61 of the grip piece 2 so that the applicator element 5*c* shown is prestressed relative to the longitudinal axis L into a fan position in which it is deflected toward the right. With this design, simply rotating the applicator element 5*c* and sliding it into a mirror-image position causes the spring element 60 to rest against a different region of the bottom 61, thus causing a deflection of the applicator element 5*c* in the other direction. This elastically prestressed deflected position is once again changed by means of the slider 4, which is slid in the axial direction 100 by a rotating control element 3*a* or a control element 3. A control edge 62 of the slider 4 in this case cooperates with an outer edge 63 of the applicator element; a movement of the slider 4 in one direction 100 pivots the applicator element in opposition to the spring pressure of the elastic element 60, toward the longitudinal axis L in a form-locked, i.e. positively guided fashion.

Figure 11:
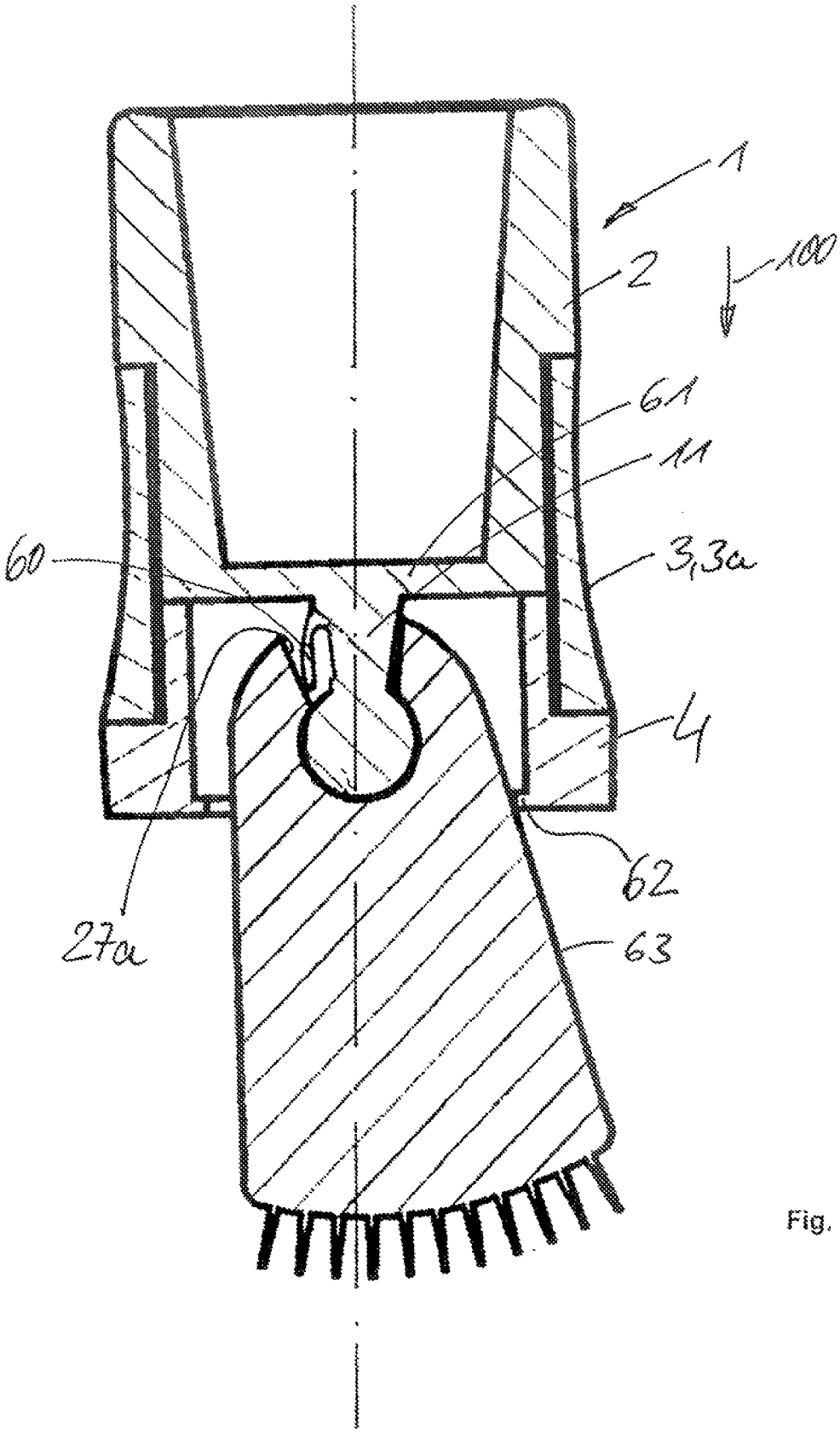
FIG. 11 is a schematic depiction of another embodiment of the applicator according to FIG. 10.

The embodiment according to FIG. 11 follows essentially the same principle. In this case, an elastic element 60 is provided for each applicator element 5*a*, 5*c* that is to be moved; the elastic element 60 is integrally connected in the region of the bearing stand 11; the free elastic arm of the elastic element 60 cooperates with a stop edge 27*a* of the widening, wedge-shaped slot opening 27 so that the applicator element 5*b* is prestressed into a fan position in which it is deflected relative to the longitudinal axis L. In this embodiment, it is advantageous that when installing the applicator elements 5*a*, 5*b*, 5*c*, it is not necessary to pay attention to their position relative to the grip piece 2, since the elastic element 60 is formed onto the correct position on the grip piece 2 or the bearing stand 11.

Figure 10:
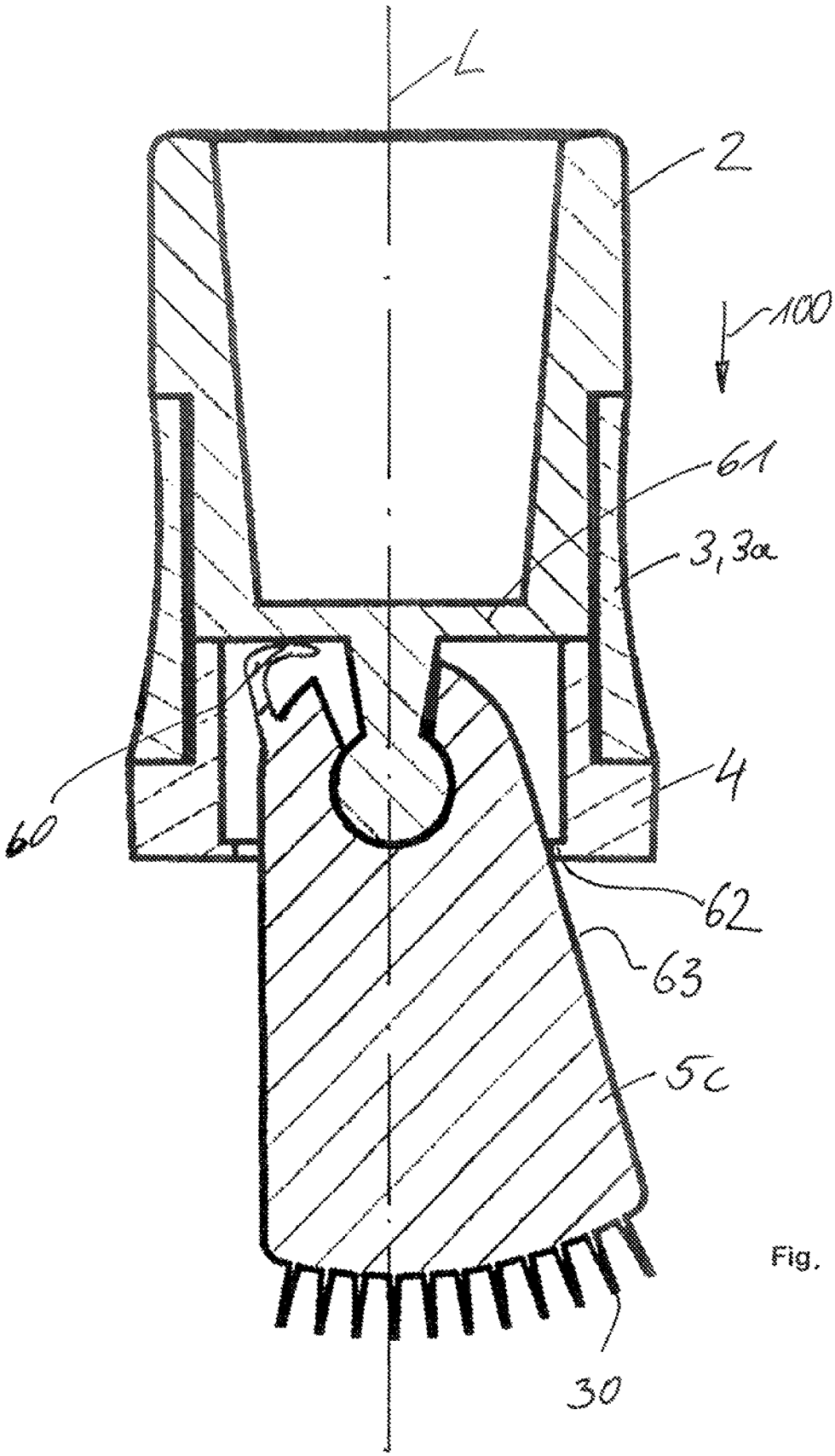
FIG. 10 schematically depicts another embodiment of an applicator according to the invention, with actuating edges and an elastic return device for the applicator elements.

By contrast, an embodiment according to FIG. 10 has the advantage that the grip piece 2 with the bearing structure 9 is easier to manufacture and that an adaptation of the strength of the elastic element 60, in particular with regard to the spring rate, can be specifically tailored to the geometric and structural embodiment of the applicator elements 5*a*, 5*b*, 5*c*.

In the above-described embodiments of applicators 1 according to the invention, the pivotability of the applicator elements (5*a*), 5*b*, 5*c* is achieved by sliding the applicator elements 5*b*, 5*c* onto the bearing axle 10; as described above, individual applicator elements, in particular at least one of them 5*a*, can also be advantageously mounted rigidly relative to the grip piece 2.

Alternative embodiments of the pivotable articulated connection of the applicator elements 5*a*, 5*b*, 5*c* relative to the grip piece 2 are described below.

By contrast with the embodiments described above, in the alternative embodiments described below, the articulating elements that produce a pivotability around a pivot axis S are embodied as integral to the applicator elements 5*a*, 5*b*, 5*c* so that between the applicator elements 5*a*, 5, 5*c* and the grip piece 2 of the applicator 1, i.e. generally speaking in the connecting region of the applicator elements 5*a*, 5*b*, 5*c* to a base body of the applicator 1, a non-pivotable, in particular rigid, connection can be provided. This is likewise preferably embodied in the form of a detachable plug connection, in particular a clip connection, with the applicator elements 5*a*, 5*b*, 5*c* engaging in detent fashion with a corresponding holding element, e.g. a modified bearing axle 10.

Figure 14:
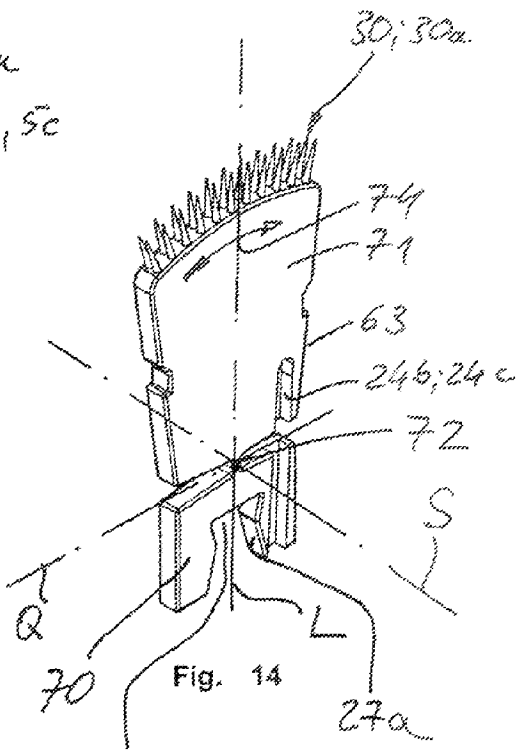
FIG. 14 shows the applicator element according to FIGS. 12 and 13, also equipped with an actuating groove.
Figure 13:
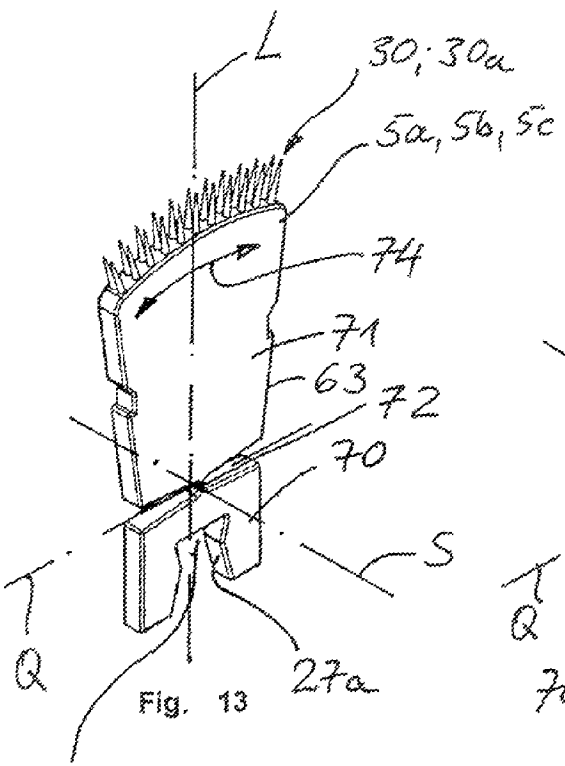
FIG. 13 is an isometric view of the applicator element according to FIG. 12.
Figure 12:
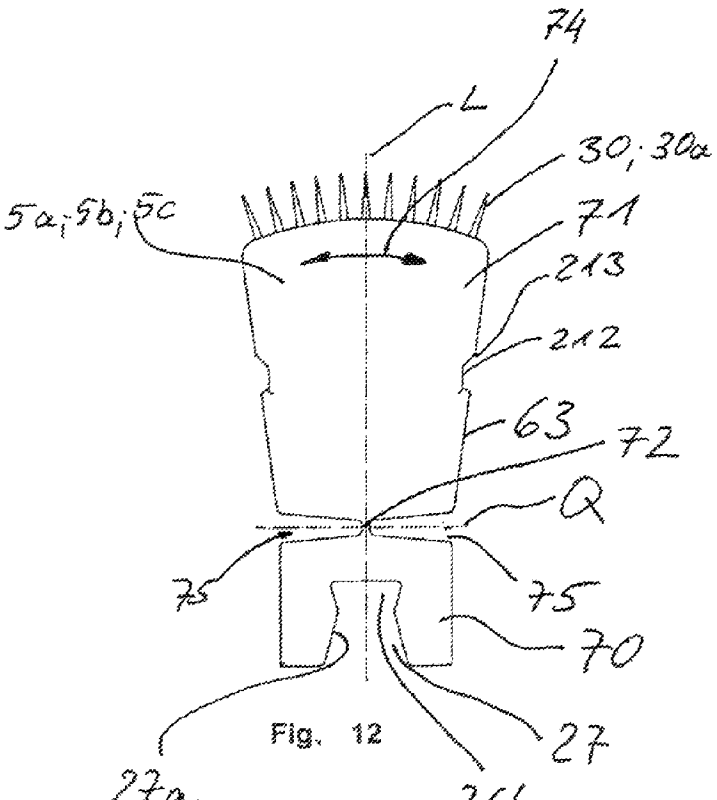
FIG. 12 is a top view of an applicator element from another an embodiment of a possible support for applicator elements of an applicator according to the invention, which allows them to pivot in an articulated fashion relative to the grip piece.

By contrast with the applicator elements described above, the applicator elements 5*a*, 5*b*, 5*c* according to FIGS. 12 through 14 have a supporting part 70 and a pivoting part 71. The supporting part 70 and pivoting part 71 of the applicator element 5*a*, 5*b*, 5*c* have an articulating device 72, which is embodied so that the pivoting part 71 can be moved relative to the supporting part 70 in pivoting fashion in a double arrow direction 74 around the pivot axis S. In the case of the applicator elements according to FIGS. 12 through 14, the articulating device 72 is embodied in the form of a narrow point, which is flexible so that it permits a pivoting motion along the double arrow direction 74. In this case, the pivot axis S' extends through the narrow point.

Wedge-shaped clearance openings 75 extend away from the narrow point, i.e. from the articulating device 72, permitting the pivoting part 71 to pivot relative to the supporting part 70.

The supporting part 70 has a modified bearing recess 26', which is not cylindrical in cross-section, but rather trapezoidal in the exemplary embodiment. As an alternative to the trapezoidal embodiment, the bearing recess 26' can also be embodied with any kind of non-rotatable contour, in particular polygonal, oval, or the like. Corresponding to the bearing recess 26', the bearing axle 10 is also modified and has an outer contour that corresponds to that of the bearing recess 26', thus achieving a seating of the supporting part 70 on the bearing structure 9 and therefore relative to the grip piece 2 that is in particular form-locked, but in any case does not permit them to pivot around a pivot axis S. The modified bearing recess 26' is associated with the slot opening 27, which in this case, i.e. in this embodiment, likewise has conically widening boundary edges 27*a*. In this embodiment, these boundary edges 27*a* do not serve as stop edges to permit a stopping of a pivoting motion, but instead serve as an insertion funnel to facilitate the clipping of the supporting parts 70 and thus the applicator elements 5*a*, 5*b*, 5*c* onto the bearing structure 9.

With regard to its geometric dimensions, the narrow point is selected so that it functions as an articulating device 72, particularly in the form of a living hinge. This means that at least in a region along the double arrow direction 74, it is easily possible to achieve the desired pivoting range within which the applicator elements 5*a*, 5*b*, 5*c* and in particular the pivoting part 71, should be able to pivot. For the pivoting of the pivoting part 71, as explained above in connection with the exemplary embodiment according to FIGS. 10 and 11, an actuating edge 62 of the slider 3 can cooperate with an outer edge 63 of the applicator element 5*a*, 5*b*, 5*c*. As an alternative or in addition to this, correspondingly provided actuating edges can also cooperate with boundary edges of the slot opening 75 on the pivoting part side.

To reset from a deflected position into a zero position or into another extreme position of the pivoting part 71 relative to the supporting part 70, for example the narrow point can be dimensioned so that its elastic restoring forces ensure a positioning in a neutral position shown in FIG. 12, for example in a symmetrical position of the pivoting part 71 with regard to the longitudinal axis L.

If the pivotability of one applicator element 5*a* should be prevented, then for example filler pieces (not shown) can be provided in the form of separate parts or integral components that fill the free openings 75.

As an alternative to the above-described actuation of the pivoting part 71 in the above-described applicators, actuating grooves 24*b*, 24*c* (see FIG. 14) can be provided, which cooperate with corresponding actuating tabs 23*b*, 23*c* (not shown in FIG. 14), thus achieving a pivotability of the pivoting part 71 along the double arrow direction 74 relative to the supporting part 70.

In another embodiment of applicator elements 5*a*, 5*b*, 5*c* of another embodiment of an applicator 1 according to the invention (according to FIGS. 15 through 17), the articulating device 72 is composed of an elastic, deformable material, in particular a plastic compound that is softer than the rest of the applicator element, with the articulating device 72 being integrally connected to both the pivoting part 71 and the supporting part 70. This can be achieved, for example, by means of a two-component injection molding.

In this embodiment of the applicator elements, free slot openings 75 are also provided, which permit the pivoting part 71 to pivot along the double arrow direction 74. In this design of the articulating device 72, the articulating device 72 is characterized by the fact that there is not a precisely defined geometric pivot axis S, but rather a pivot axis point cloud, because the articulating device 72 is embodied, for example, in the form of an elastic ball that can in principle be elastically deformed in all directions. For example, a pivoting around a perpendicular axis Q or even a twisting around the longitudinal axis L can be achieved with this embodiment of the articulating device 72. In the specific application, the main pivoting direction is definitely the pivoting that occurs around the pivot axis S since the applicator elements 5*a*, 5*b*, 5*c* prevent one another from pivoting around the axis Q when they are arranged in the packet. A twisting around the axis L or a pivoting around other axes that are not explicitly described here, both during application and during adjustment of the fan, is not very likely given the forces that occur, but also cannot be ruled out completely. Particularly in the embodiment of the articulating device 72 with a soft material subregion, but also to a limited degree in the embodiment of the applicator elements 5*a*, 5*b*, 5*c* with a narrow point according to FIGS. 12 through 14, a certain elasticity around the axis Q can be achieved, which can be advantageous particularly with the forces that occur when applying mascara to the eyelashes since such forces tend to cause a pivoting around the axis Q. This can advantageously produce a smooth application feel if the applicator is embodied so that its applicator elements are able to pivot, in particular elastically, around a transverse axis Q, at least to a limited degree. A similar smooth feel can be achieved in an embodiment according to FIGS. 1 through 10 if the applicator elements 5*a*, 5*b*, 5*c* are composed not of an essentially rigid plastic, but for example of an elastically deformable plastic so that forces that act approximately in the direction of the pivot axis S cause the applicator elements 5*a*, 5*b*, 5*c* to flex and thus permit the achievement of a smooth application feel.

In the majority of cases, forces resulting from the application of mascara to eyelashes with the applicator according to the invention act in the direction of the pivot axis S (direction 101) or at least act with their main component in the direction of the pivot axis S since they are essentially oriented perpendicular to the plate plane of the applicator elements.

With regard to the supporting parts 70, the applicator elements 5*a*, 5*b*, 5*c* according to FIGS. 15 through 17 are embodied similarly to the above-described embodiments according to FIGS. 12 through 14 so that a repeat of the description here can be omitted.

Exemplary embodiments of cosmetic devices 200 according to the invention that are equipped with the applicator according to the invention 1 are described below. Everything that has been said about the applicators 1 should naturally also be taken to apply to the cosmetic devices equipped with the applicators 1.

Some exemplary embodiments of a cosmetic device according to the invention equipped with the applicators according to the invention are described below.

Figure 18:
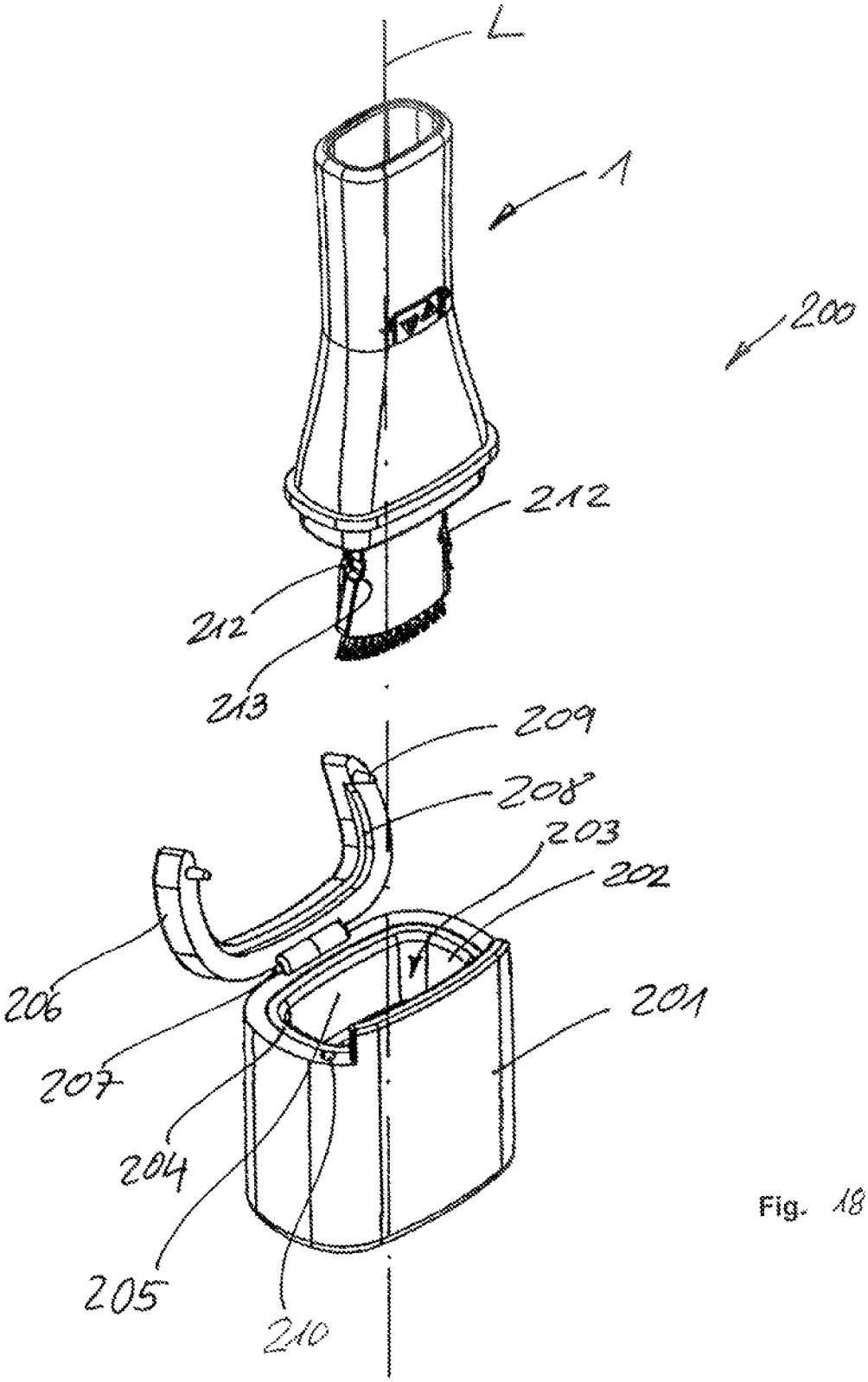
FIG. 18 is an exploded view of a first embodiment of a cosmetic device according to the invention, equipped with an applicator according to FIGS. 1 through 3.
Figure 19:
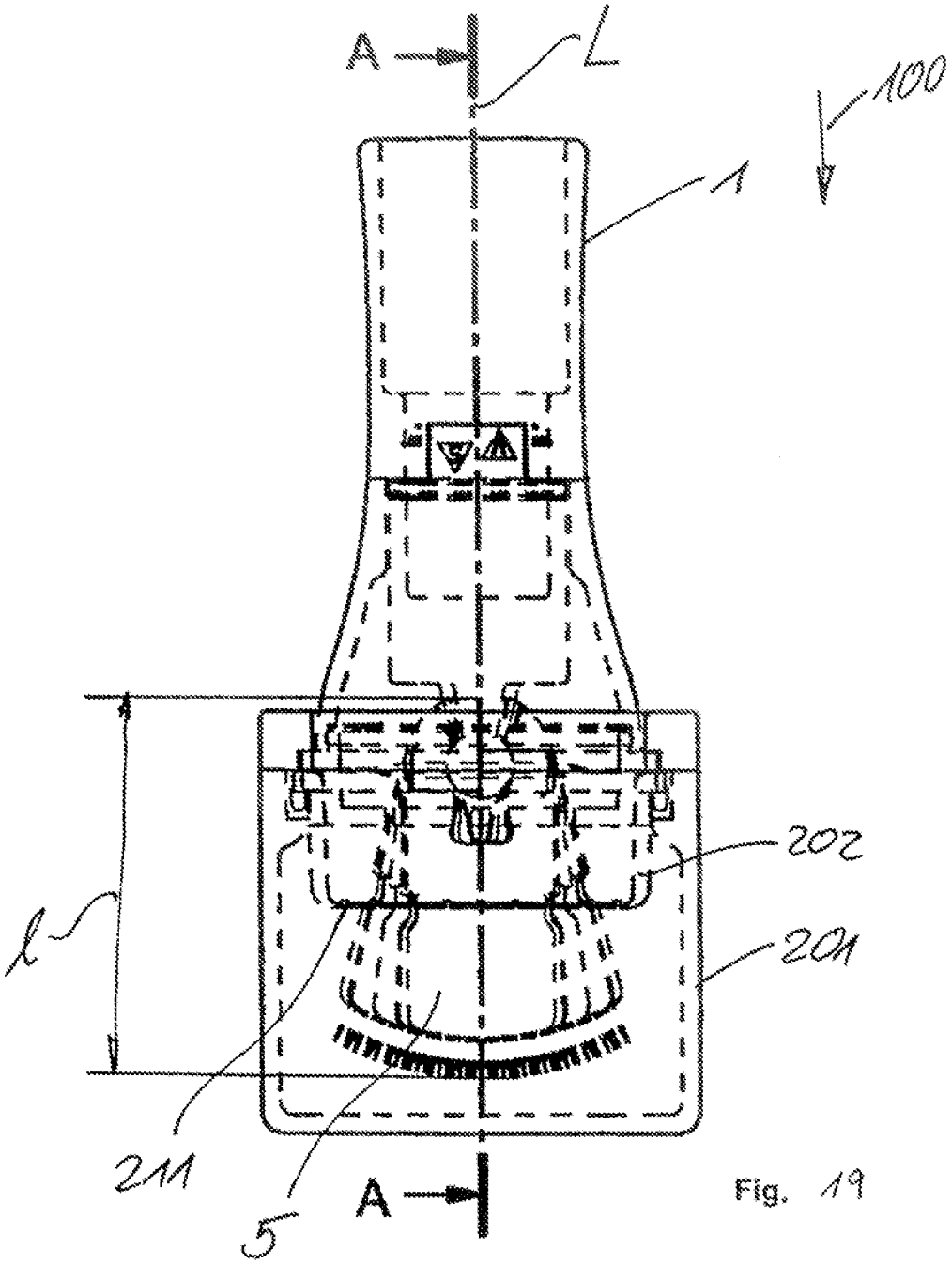
FIG. 19 is a side view of the cosmetic device according to FIG. 12 in the assembled state, with the hidden lines shown.
Figure 20:
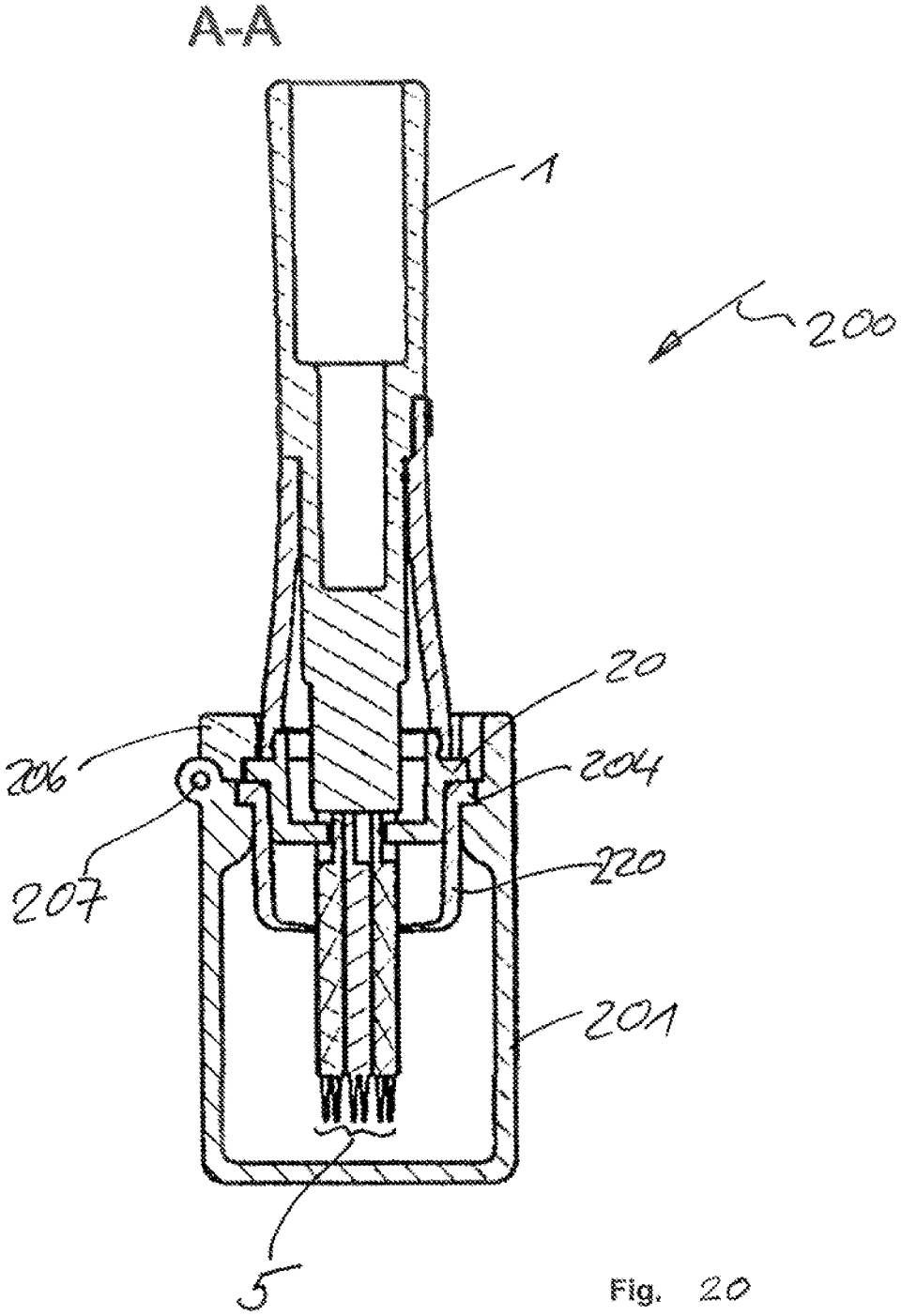
FIG. 20 is a longitudinal section through the cosmetic device according to FIG. 13 along the line A-A.
Figure 21:
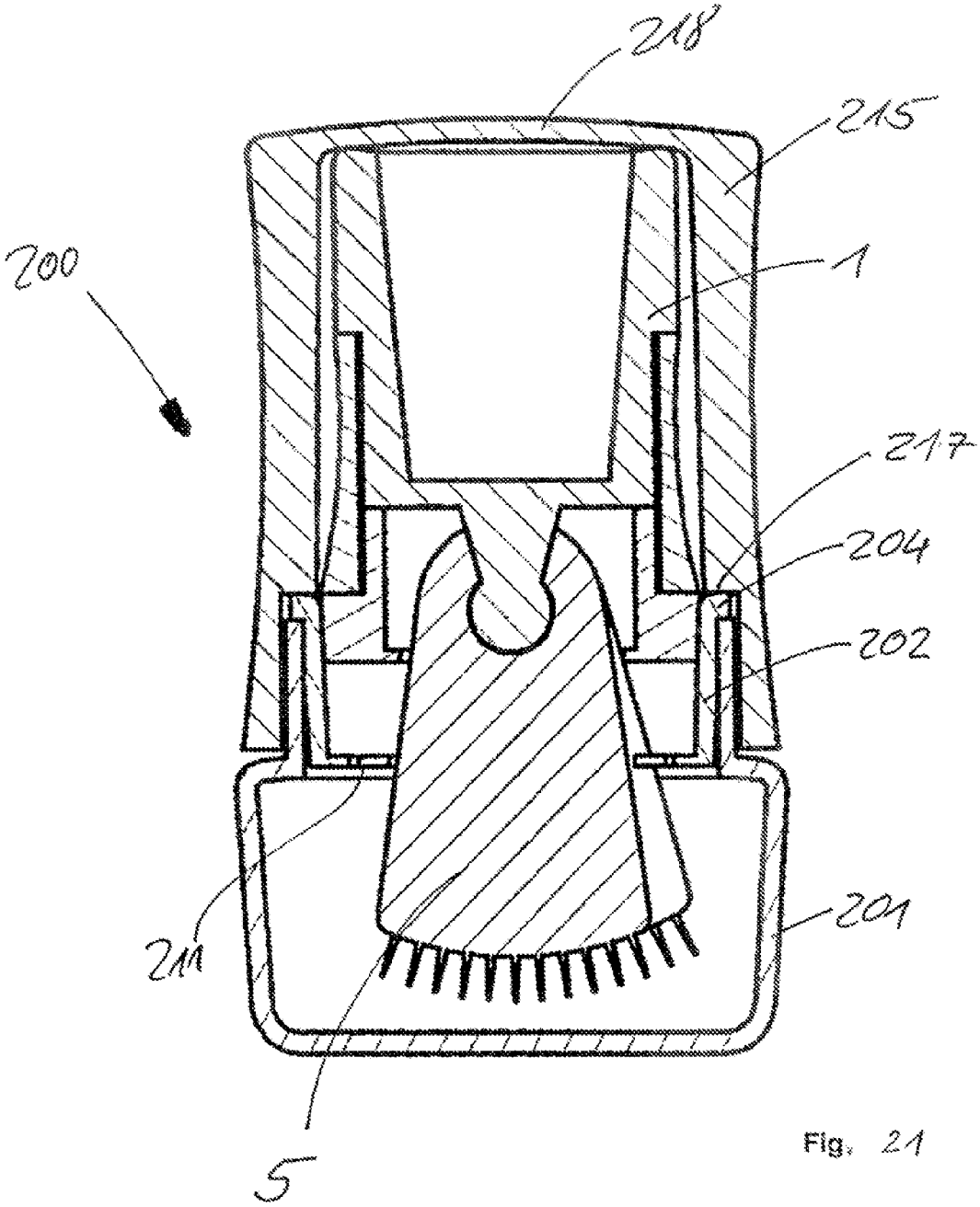
FIG. 21 is a longitudinal section through another embodiment of a cosmetic device according to the invention, with an applicator according to FIGS. 5 through 7.
Figure 22:
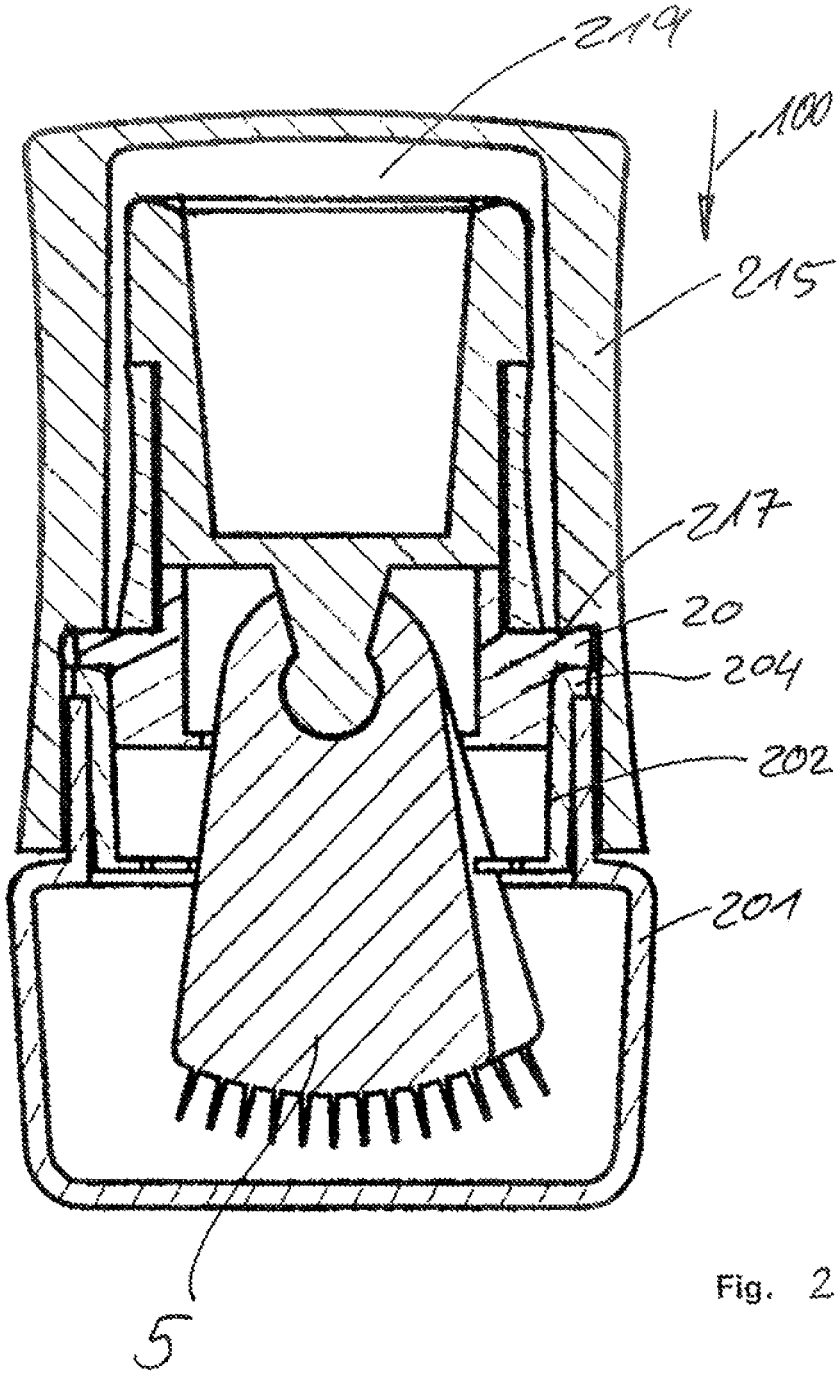
FIG. 22 is a longitudinal section through a modified version of the cosmetic device according to FIG. 15.

A first embodiment of the cosmetic device 200 according to the invention is shown in an exploded view in FIGS. 18 through 20. The cosmetic device 200 has an applicator 1 and has a container 201 for storing cosmetic to be applied, in particular for storing mascara compound.

In the region of a proximal end of the container 201, this is embodied as open for the insertion of the applicator 1. In the region of the insertion opening, there is a stripper 202 which will be described below in connection with FIGS. 17 through 20.

The insertion opening 203 is matched to the outer geometry of the applicator 1 so that the collar 20 of the applicator 1 comes to rest against a shoulder 204 of the stripper 202 when the applicator 1 is inserted into the container 201. In this case, the outer circumferential surface 25 of the applicator 1, in particular of the slider 4, is matched to an inner contour 205 of the stripper 202 so that the outer circumferential surface 25 and the inner contour 205 form a fluid-tight and air-tight fit, thus preventing mascara compound from leaking out of the container 201 when the applicator 1 is in the inserted position.

To mechanically fix the applicator 1 relative to the container 201, a closing bracket 206 is provided, which is attached to the edge of the container 201 so that it is able to fold around a pivot axis 207. For example, the three-dimensional form of the closing bracket is matched to the outer contour of the applicator 1 in the region of the insertion opening 203 and for example is essentially U-shaped. In particular, the closing bracket 206 has a holding notch 208 that extends around almost the entire circumference of the U-shaped closing bracket 206 and in the assembled state, cooperates with the collar 20, in particular with the proximal flat side of the collar 20 of the applicator 1. The applicator 1 is thus mechanically held with its collar 20 between the stripper 202—in particular the shoulder 204 of the stripper 202—and the closing bracket 206.

To fasten the closing bracket 206 in detent fashion in a closed position according to FIG. 14, the closing bracket 206 has clip devices 209 by means of which the bracket can be locked in detent fashion in clip recesses 210 when it is in the closed position. In FIG. 12, clip devices and clip recesses are only schematically depicted as pins and openings.

The stripper 202 is embodied as essentially trough-shaped or pot-shaped and has a stripper bottom 211. In the assembled state of the applicator, the stripper bottom 211 is situated in the container 201 in the axial direction 100 so that the actuating grooves 24*b*, 24*c* of the applicator elements 5*a*, 5*b*, 5*c* are preferably situated completely within the interior of the trough or pot of the stripper 202. A slot in the bottom 211 makes it possible for the applicator elements 5*a* to 5*c* to pass through the stripper bottom 211 and dip into the container 201. When the cosmetic device is assembled in the axial direction, the stripper bottom 211 is preferably approximately situated so that it comes into contact with the applicator elements 5*a*, 5*b*, 5*c* over approximately half the length l of the applicator device. Particularly in the region in which the applicator elements 5*a*, 5*b*, 5*c* pass through the bottom 211 of the stripper, the applicator elements 5*a*, 5*b*, 5*c* have notches 212 in the region of their outer edges so that in this region, the applicator elements 5*a* to 5*c* are embodied as slightly narrower with regard to their lateral span. This achieves an effective reduction of the length of the contact line between the bottom 211 of the stripper 202 and the applicator elements 5*a*, 5*b*, 5*c*, resulting in an improved sealing of the applicator elements 5*a*, 5*b*, 5*c* that move relative to one another and thus also resulting in an improved stripping result, since no matter what position they are currently in, the applicator elements 5*a*, 5*b*, 5*c* always touch the stripper 201 in approximately the same region. On their distal side, the notches 212 have a chamfer-like bevel 213, which makes it unnecessary to exert as much force, i.e. reduces the required pulling force, particularly when pulling the applicator 1 out of the stripper 202.

The notches 212 can also be used for grasping the applicator elements 5*a*, 5*b*, 5*c* with an installing tool, permitting a fan packet of applicator elements 5*a*, 5*b*, 5*c* to be installed as a unit or permitting the applicator elements 5*a*, 5*b*, 5*c* to be installed individually.

According to another embodiment of the cosmetic device according to the invention (FIG. 15), the applicator 1, in particular the slider 4, does not have a shoulder but instead produces a seal with the stripper 202 merely by means of its outer surface 25 in the assembled state of the cosmetic device. In this embodiment, a cap 215 for sealing the cosmetic device 200 is provided, which covers the entire applicator 1 and is connected to the container 201 in a customary way by means of a screw connection or a plug-in connection 216. The cap 215 has a shoulder 217 at a suitable location, with which it is placed against the stripper 202 or its shoulder 204. With regard to its axial length, the cap can in particular be dimensioned so that when the cap is set in place, the applicator 1 is brought into a starting position with the slider 4 resting against the step. When being inserted, if the applicator 1 is in an extended position, i.e. the slider 4 together with the control element 3 is in a position in which it is slid down all the way in the direction 100 at the time of insertion, then the action of screwing the cap 215 on—or in this embodiment, the action of sliding it on—automatically moves the applicator into the starting position according to FIG. 3 as the cap 215 is being slid into place and fastened there. This has the advantage that when pulling out the applicator after opening the cap 215, the user always finds applicator 1 in a standardized (e.g. maximally deflected) position. Depending on the embodiment of the slider mechanism, this can mean that when the applicator is used again, the applicator elements 5*a*, 5*b*, 5*c* are either in a maximally fanned-out position shown in FIG. 1 or in a still maximally folded-in position shown in FIG. 9*c*.

In another embodiment of the cosmetic device according to FIG. 16, the axial length of the cap is chosen so that between the free end of the grip piece 2 and a cap bottom 218, there is a gap 219, which is in particular of sufficiently large dimensions that even in a fully extended state in which the control element 3 and slider 4 are situated in an end position in which they are slid the maximum amount in the direction 100 relative to the starting position in FIG. 3, the applicator 1 can be inserted and is not compressed by the cap or its cap bottom during the closing of the cosmetic device. This arrangement has the advantage that in a subsequent use, the user always finds the applicator 1 in the same state it was in the last time it was inserted into the container 201. To ensure a secure hold of the applicator 1 in the container 201, in this embodiment, the slider 4 is provided with the previously described collar 20, which cooperates with the shoulder 204 of the stripper in the assembled state. In this embodiment, the shoulder 217 of the cap 215 cooperates directly with the collar 20 of the slider 4.

The container 201 of the cosmetic device 200 can be embodied in the form of a rigid body containing a predetermined quantity of a cosmetic, e.g. a mascara preparation. As an alternative, the container 201 can also be composed of a material that is squeezable, i.e. that allows the user to reduce its volume by exerting hand pressure, which allows the mascara compound in the container 201 to be moved toward the inserted applicator device 5 when the container 201 is squeezed.

It is also possible without going beyond the scope of the invention to provide the applicator elements 5*a*, 5*b*, 5*c* with actuating devices 6, which by contrast with the groove/tab actuating devices or spring-loaded actuating devices specifically described above, can also perform the driving and pivoting of the applicator elements 5*a*, 5*b*, 5*c* on the basis of gearing. For example, a toothed rack that can be moved axially by means of the actuating device 6 can engage with corresponding teeth on the applicator elements 5*a*, 5*b*, 5*c* and thus provide for a pivoting of the applicator elements 5*a*, 5*c*.

In the applicator according to the invention, it is particularly advantageous that the modular design, in particular of the applicator device 5, permits a variety of different applicator devices 5 that are composed of identical or different applicator elements 5*a*, 5*b*, 5*c* to be attached to one and the same basic mechanism composed of the grip piece 2, the control element 3, and the slider 4. On the one hand, this makes it possible to offer applicator assortments, for example with a base body 2, 3, 4 and a certain assortment of applicator elements, also allowing the user to assemble different applicators as needed.

The possibility of embodying the applicator elements 5*a*, 5*b*, 5*c* as identical to one another enables an inexpensive manufacture with a low, manageable total number of individual parts. In particular, the simple and reliable embodiment of the actuating mechanism, i.e. the actuating device 6, achieves a reliable function that continues to function properly for a long time.

The applicator according to the invention naturally also offers the possibility of embodying the applicator elements 5*a*, 5*b*, 5*c* differently from one another, particularly with regard to their material composition and selection of materials as well as with regard to their three-dimensional geometric form so that a variety of applicator element types 5*a*, 5*b*, 5*c* can be used to assemble a custom-designed fan slat packet composed of different applicator elements 5*a*, 5*b*, 5*c*. It is thus easily possible to produce an applicator that can be adapted to a wide variety of customer desires.

Another important advantage of the invention is naturally the fact that it discloses an applicator that has a function for increasing the volume, for example of eyelashes, and, through a simple adjustment of the applicator, also has a good functionality in terms of separating the lashes that are to be wetted with mascara.

The invention claimed is:

1. An applicator for cosmetics, in particular a mascara applicator, comprising:

at least one grip piece on which at least one applicator device is arranged, and the applicator device has at least two applicator elements that are movable relative to each other;

wherein the applicator device is embodied in the form of a fan and the applicator elements constituting the fan are movable from a first fan position into a second fan position and/or vice versa, with the applicator elements being folded-in closer to one another in the first fan position or fanned-out farther from one another in the second fan position.

2. The applicator as recited in claim 1, wherein the movement in both directions occurs in a positively guided fashion using form-locked cooperation of an actuating mechanism or is acted on by an elastic force in at least one direction.

3. The applicator as recited in claim 1, wherein the applicator elements have a free distal front surface on which are arranged bristles that protrude at least distally.

4. The applicator as recited in claim 3, wherein the applicator elements have a plate-like or shell-like three-dimensional form and in a position in which the applicator elements are maximally or minimally deflected relative to one another, the applicator elements have a maximum effective bristle spacing $d_{WMax}$ to one another in a projection perpendicular to the plate plane of the applicator elements or perpendicular to the tangential plane of the shell-shaped applicator elements.

5. The applicator as recited in claim 1, wherein the applicator elements are embodied in the manner of at least partly overlapping fan slats and are situated so that the applicator elements are able to pivot around a pivot axis relative to the grip piece.

6. The applicator as recited in claim 5, wherein the pivot axis encloses an angle with a longitudinal axis of the applicator and the angle $\delta$ lies in a range between 45° and 90°.

7. The applicator as recited in claim 5, wherein with regard to a pivoting motion around the pivot axis, one of the at least two applicator elements or at least one additional applicator element is connected to the grip piece in a detachably rigid fashion, or is integrally connected to the grip piece.

8. The applicator as recited in claim 1, wherein the movable applicator elements are prestressed by an elastic element in the direction of a maximum deflection and by an actuating device, can be moved out of the position of maximum deflection and positioned relative to one another in an infinitely variable or detent-indexed fashion.

9. The applicator as recited in claim 3, wherein free front surfaces of the applicator elements support bristles that are injection-molded onto the applicator elements, which are spaced apart from one another by a distance d, and in at least one position of the applicator elements, the bristles of all of the applicator elements, are aligned with one another, thus producing a maximum effective bristle spacing $d_{WMax}$.

10. The applicator as recited in claim 3, wherein two or n applicator elements are provided and in a second or nth position of the applicator elements, the bristles have an effective bristle spacing $d_W$ that is equal to half or the nth part of the maximum effective bristle spacing $d_{WMax}$.

11. The applicator as recited in claim 8, wherein the actuating device includes a slider that is able to slide axially along a longitudinal axis of the applicator and is equipped with actuating edges or actuating tabs, which cooperate in a positively guided fashion with an outer edge or with an actuating groove of the applicator elements in order to pivot the movable applicator elements.

12. The applicator as recited in claim 11, wherein the slider cooperates in a sealed fashion with a stripper of a cosmetic device.

13. The applicator as recited in claim 11, wherein the actuating edges or actuating tabs are actuatable by a rotating mechanism or sliding mechanism.

14. The applicator as recited in claim 4, wherein the plate-like applicator elements are embodied as elastically deformable and have a spherically curved three-dimensional form and are arranged like shells stacked inside one another.

15. The applicator as recited in claim 3, wherein the bristles of an applicator element are arranged in one or more rows extending side by side.

16. The applicator as recited in claim 3, wherein the applicator elements have bristles of different lengths and/or different three-dimensional forms.

17. The applicator as recited in claim 3, wherein the length of the bristles of a first applicator element is different from the length of the bristles of another applicator element.

18. The applicator as recited in claim 1, wherein the pivoting support and rigid support of individual applicator elements is achieved by a bearing structure that is integrally connected to the grip piece.

19. The applicator as recited in claim 18, wherein the applicator elements are clipped onto a bearing axle of the bearing structure.

20. The applicator as recited in claim 1, wherein the geometric three-dimensional forms of the applicator elements are identical to one another.

21. The applicator as recited in claim 18, wherein the applicator elements have a bearing recess, which corresponds to a bearing axle of the bearing structure and is open on one side, and have a slot opening that has stop edges and in an assembled state, cooperates with the outer surfaces of a bearing stand, which supports the bearing axle of the bearing structure without play in the case of a fixed (rigid) support of the applicator elements and with play in the case of a pivoting support of the applicator elements relative to the bearing structure.

22. The applicator as recited in claim 1, wherein the applicator elements have an articulating device.

23. The applicator as recited in claim 22, wherein the articulating device connects a pivoting part and a supporting part of the applicator elements so that the applicator elements are able to pivot at least around a pivot axis.

24. The applicator as recited in claim 22, wherein the articulating device is embodied in the form of a living hinge.

25. The applicator as recited in claim 22, wherein the articulating device is composed of a plastic material that is softer than a plastic material of which the applicator elements are formed.

26. The applicator as recited in claim 22, wherein the applicator elements are manufactured using a two-component or multi-component injection-molding process and the bristles and articulating device are made of a plastic material that is softer and more elastically deformable than a plastic material of which the applicator elements are formed.

27. The applicator as recited in claim 23, wherein the supporting part has a bearing recess, which permits the supporting part to be clipped onto the bearing structure in a non-pivoting fashion.

28. The applicator as recited in claim 5, wherein it is possible to pivot and/or twist at least subregions of the applicator elements in space around various axes other than the pivot axis.

29. A cosmetic unit having at least one applicator as recited in claim 1.

30. The cosmetic unit as recited in claim 29, further comprising a container, a stripper, and a closing device.

31. The cosmetic unit as recited in claim 30, wherein the closing device is a cap, which completely envelops the applicator protruding from the container.

32. The cosmetic unit as recited in claim 30, wherein the closing device is a closing bracket, which in the closed state, cooperates with a corresponding collar of the applicator and holds the collar so that at least the grip piece remains at least partially uncovered in the closed state.

* * * * *